US007721460B2

(12) United States Patent
Albers et al.

(10) Patent No.: US 7,721,460 B2
(45) Date of Patent: May 25, 2010

(54) MICRO-CYCLE ENERGY TRANSFER SYSTEMS AND METHODS

(76) Inventors: Walter F. Albers, 4901 E. Arroyo Verde Dr., Paradise Valley, AZ (US) 85253; Yijun Yuan, Jiller Technology Development. Co., Ltd, Society Develop General Ex. Region, Yang Xunqiao, Shaoxing, Zheijiang (CN) 312028

( * ) Notice: Subject to any disclaimer, the term of this patent is extended or adjusted under 35 U.S.C. 154(b) by 118 days.

(21) Appl. No.: 11/780,407

(22) Filed: Jul. 19, 2007

(65) Prior Publication Data

US 2008/0011466 A1 Jan. 17, 2008

Related U.S. Application Data

(63) Continuation of application No. 11/015,701, filed on Dec. 17, 2004, now abandoned.

(51) Int. Cl.
*F26B 11/00* (2006.01)

(52) U.S. Cl. ..... 34/80

(58) Field of Classification Search ..... 34/487, 34/595, 601, 77, 79, 80, 210
See application file for complete search history.

(56) References Cited

U.S. PATENT DOCUMENTS 2,017,027 A * 10/1935 Forrest ..... 62/92
2,249,625 A * 7/1941 Bichowsky ..... 34/537
2,557,204 A * 6/1951 Richardson ..... 95/191
3,094,574 A * 6/1963 Glasgow et al. ..... 261/23.1
3,102,399 A * 9/1963 Meckler ..... 62/271
3,128,158 A * 4/1964 Colvin et al. ..... 34/557
3,257,737 A * 6/1966 Margittai ..... 34/473
3,257,738 A * 6/1966 Margittai ..... 34/473
3,277,954 A * 10/1966 Meckler ..... 165/230
3,348,601 A * 10/1967 Hill ..... 159/13.4
3,405,759 A * 10/1968 Burrus et al. ..... 165/299
3,738,016 A * 6/1973 Margittai ..... 34/92
3,857,911 A * 12/1974 Szucs et al. ..... 261/112.1
3,940,860 A * 3/1976 Unterreiner ..... 34/535
4,009,083 A * 2/1977 Lyon et al. ..... 203/49
4,009,229 A * 2/1977 Szucs et al. ..... 261/72.1
4,189,848 A * 2/1980 Ko et al. ..... 34/473
4,287,721 A * 9/1981 Robison ..... 62/94
4,307,519 A * 12/1981 Szucs et al. ..... 34/473
4,367,595 A * 1/1983 Szucs et al. ..... 34/473
4,832,115 A * 5/1989 Albers et al. ..... 165/104.31
4,846,977 A * 7/1989 DeVellis et al. ..... 210/640
4,887,438 A * 12/1989 Meckler ..... 62/271
4,903,503 A * 2/1990 Meckler ..... 62/238.3
4,941,324 A * 7/1990 Peterson et al. ..... 62/94
4,982,782 A * 1/1991 Albers et al. ..... 165/111
4,984,434 A * 1/1991 Peterson et al. ..... 62/94
4,987,748 A * 1/1991 Meckler ..... 62/176.1
5,020,334 A * 6/1991 Wilkinson ..... 62/271

(Continued)

*Primary Examiner*—Stephen M. Gravini
(74) *Attorney, Agent, or Firm*—Parsons & Goltry; Michael W. Goltry; Robert A. Parsons

(57) ABSTRACT

A carrier supports property-transferring material and includes a first portion exposed to a first property and a second portion exposed to a second property. The first property is different from the second property causing the property-transferring material to develop micro-cyclic property transfer between the first and second properties. The first and second properties each include at least one of heat and mass.

10 Claims, 12 Drawing Sheets

U.S. PATENT DOCUMENTS 5,020,335 A * 6/1991 Albers et al. ..... 62/271
5,020,588 A * 6/1991 Albers et al. ..... 165/111
5,058,394 A * 10/1991 Wilkinson ..... 62/271
5,070,703 A * 12/1991 Wilkinson ..... 62/94
5,123,481 A * 6/1992 Albers et al. ..... 165/111
5,131,238 A * 7/1992 Meckler ..... 62/271
5,146,978 A * 9/1992 Albers et al. ..... 165/111
5,181,387 A * 1/1993 Meckler ..... 62/59
5,191,771 A * 3/1993 Meckler ..... 62/271
5,297,398 A * 3/1994 Meckler ..... 62/271
5,351,497 A * 10/1994 Lowenstein ..... 62/94
5,471,852 A * 12/1995 Meckler ..... 62/271
5,534,186 A * 7/1996 Walker et al. ..... 252/194
5,536,303 A * 7/1996 Ebeling ..... 95/166
5,565,139 A * 10/1996 Walker et al. ..... 252/194
5,817,167 A * 10/1998 DesChamps ..... 95/113
5,958,110 A * 9/1999 Harris et al. ..... 95/166
6,044,640 A * 4/2000 Guimaraes ..... 60/783
6,134,903 A * 10/2000 Potnis et al. ..... 62/271
6,138,470 A * 10/2000 Potnis et al. ..... 62/271
6,158,242 A * 12/2000 Lu ..... 62/637
6,216,483 B1 * 4/2001 Potnis et al. ..... 62/271
6,361,588 B1 * 3/2002 Moratalla ..... 96/4
6,405,543 B2 * 6/2002 Kopko ..... 62/89
6,418,728 B1 * 7/2002 Monroe ..... 62/3.2
6,422,729 B1 * 7/2002 Rohrbach et al. ..... 362/547
6,487,872 B1 * 12/2002 Forkosh et al. ..... 62/271
6,494,053 B1 * 12/2002 Forkosh et al. ..... 62/271
6,497,107 B2 * 12/2002 Maisotsenko et al. ..... 62/121
6,513,339 B1 * 2/2003 Kopko ..... 62/94
6,546,746 B2 * 4/2003 Forkosh et al. ..... 62/271
6,584,797 B1 * 7/2003 Smith et al. ..... 62/371
6,688,132 B2 * 2/2004 Smith et al. ..... 62/371
6,701,724 B2 * 3/2004 Smith et al. ..... 62/106
6,776,001 B2 * 8/2004 Maisotsenko et al. ..... 62/315
6,789,288 B2 * 9/2004 Wijmans et al. ..... 15/188
6,911,121 B1 * 6/2005 Beckman ..... 203/49
6,968,711 B2 * 11/2005 Smith et al. ..... 62/371
6,976,365 B2 * 12/2005 Forkosh et al. ..... 62/94
7,007,453 B2 * 3/2006 Maisotsenko et al. .... 60/39.511
7,132,008 B2 * 11/2006 Wijmans et al. ..... 96/6
7,231,967 B2 * 6/2007 Haglid ..... 165/231
7,260,945 B2 * 8/2007 Landry ..... 62/94
7,306,650 B2 * 12/2007 Slayzak et al. ..... 95/91
7,306,654 B2 * 12/2007 King et al. ..... 95/224
7,313,926 B2 * 1/2008 Gurin ..... 62/324.2
7,338,548 B2 * 3/2008 Boutall ..... 95/14
2001/0003902 A1 * 6/2001 Kopko ..... 62/89
2001/0013226 A1 * 8/2001 Potnis et al. ..... 62/271
2002/0038552 A1 * 4/2002 Maisotsenko et al. ..... 62/121
2002/0116935 A1 * 8/2002 Forkosh et al. ..... 62/93
2002/0164944 A1 * 11/2002 Haglid ..... 454/228
2003/0000230 A1 * 1/2003 Kopko ..... 62/82
2003/0014982 A1 * 1/2003 Smith et al. ..... 62/106
2003/0014983 A1 * 1/2003 Maisotsenko et al. ..... 62/121
2003/0014993 A1 * 1/2003 Smith et al. ..... 62/371
2003/0014994 A1 * 1/2003 Smith et al. ..... 62/371
2003/0029185 A1 * 2/2003 Kopko ..... 62/271
2003/0126876 A1 * 7/2003 Maisotsenko et al. ..... 62/315
2004/0031282 A1 * 2/2004 Kopko ..... 62/271
2004/0079228 A1 * 4/2004 Wijmans et al. ..... 95/188
2004/0103637 A1 * 6/2004 Maisotsenko et al. ..... 60/39.59
2004/0112077 A1 * 6/2004 Forkosh et al. ..... 62/271
2004/0206242 A1 * 10/2004 Wijmans et al. ..... 96/234
2004/0211207 A1 * 10/2004 Forkosh et al. ..... 62/271
2004/0231346 A1 * 11/2004 Smith et al. ..... 62/103
2004/0231512 A1 * 11/2004 Slayzak et al. ..... 95/211
2004/0261440 A1 * 12/2004 Forkosh et al. ..... 62/271
2005/0109052 A1 * 5/2005 Albers et al. ..... 62/271
2005/0158198 A1 * 7/2005 Albers et al. ..... 417/572
2005/0204914 A1 * 9/2005 Boutall ..... 95/10
2005/0257551 A1 * 11/2005 Landry ..... 62/271
2006/0130654 A1 * 6/2006 King et al. ..... 95/231
2007/0089449 A1 * 4/2007 Gurin ..... 62/324.2
2007/0137996 A1 * 6/2007 Beckman ..... 202/158
2007/0243100 A1 * 10/2007 Miyauchi et al. ..... 422/5
2007/0289323 A1 * 12/2007 Swofford et al. ..... 62/256
2008/0000630 A1 * 1/2008 Haglid ..... 165/287
2008/0003940 A1 * 1/2008 Haglid ..... 454/228
2008/0011466 A1 * 1/2008 Albers et al. ..... 165/185
2008/0135495 A1 * 6/2008 Sher ..... 210/748
2009/0038668 A1 * 2/2009 Plaisted ..... 136/244
2009/0071621 A1 * 3/2009 Oles ..... 164/7.1

* cited by examiner

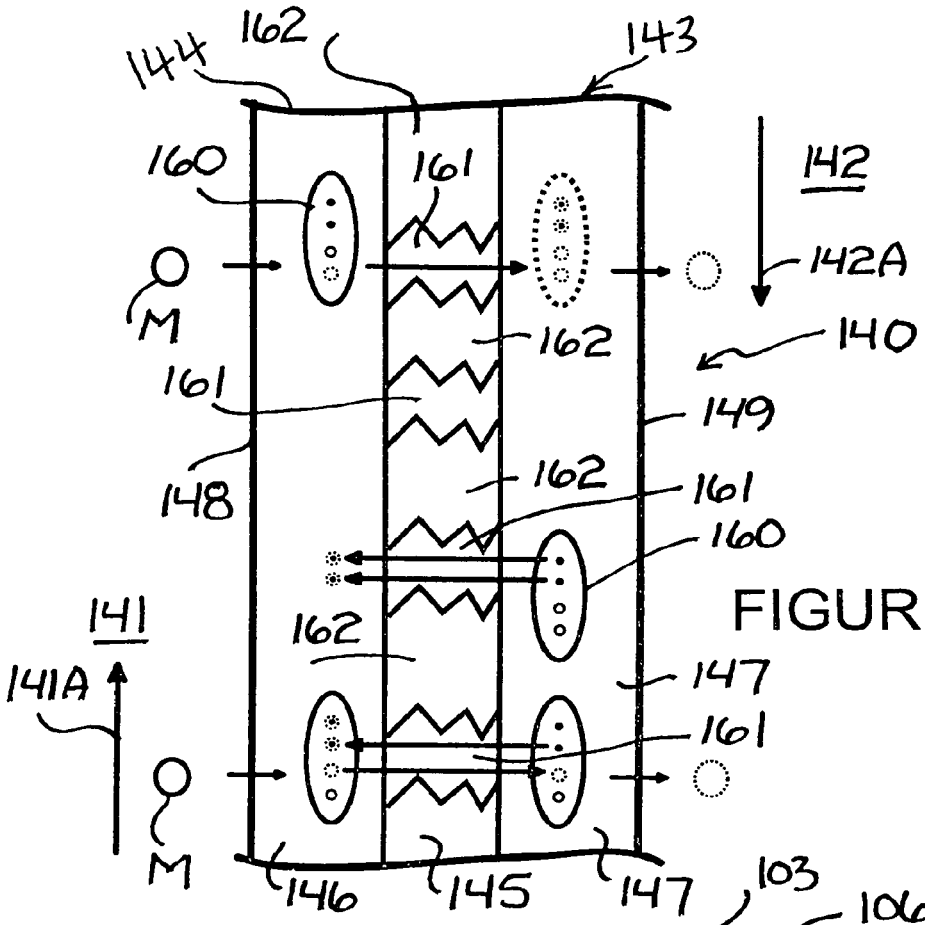
FIGURE 3
FIGURE 4
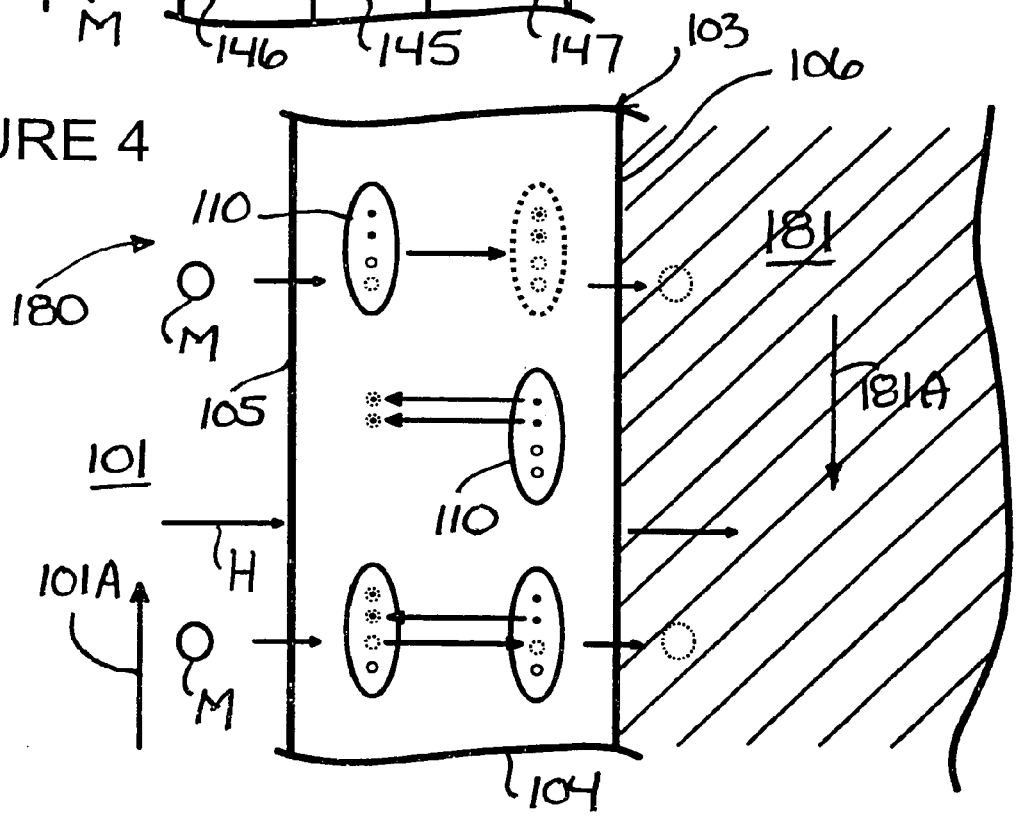

MICRO-CYCLE ENERGY TRANSFER SYSTEMS AND METHODS

CROSS-REFERENCE TO RELATED APPLICATIONS

This application claims the benefit of People's Republic of China Patent Application 200310122814.4, filed 21 Dec. 2003, People's Republic of China Patent Application 200320122847.4, filed 21 Dec. 2003, People's Republic of China Patent Application 200310122820.x, filed 21 Dec. 2003, and People's Republic of China Patent Application No. 200410015955.0, filed 15 Jan. 2004.

BACKGROUND OF THE INVENTION

1. Field of the Invention

The present invention relates to systems and methods for transferring properties, such as heat and mass, between substances, such as fluids and/or solids.

2. Background of the Invention

Changing the energy content of a substance is often required in scientific experimentation and analyses and in air handling and management applications in which heating and cooling is provided. Changing the energy of a substance can involve changing the heat content of the substance, the mass or moisture content of the substance, or both. Such is the case with substances such as gases, liquids, and various types of solid material. In order to produce a desired change in the energy content of a given substance, the substance must be treated with a mechanical heat transfer device, such as a heating unit or a cooling unit, or a mechanical mass transfer device, such as a humidifier or a dehumidifier or selective membranes that operate with a sizable pressure differential. However, using such devices is expensive and requires large amounts of electrical power, which is not entirely acceptable and desired, especially in situations where such devices are not available or during periods of mechanical failure. Furthermore, heat transfer devices and mass transfer devices are bulky and not entirely practical in situations in which space is at a premium.

SUMMARY OF THE INVENTION

Disclosed herein are exemplary embodiments of systems and methods for transferring energy between different substances which are low in cost, efficient, easily controlled, easy to implement, and useful in scientific applications, and heating and cooling applications, such as air conditioning systems, liquid conditioning systems, gas/liquid conditioning systems, in systems in which energy transfer between one or more solids and one or more liquids is desired.

According to the invention, a system includes a carrier supporting property-transferring material and including a first portion exposed to a first property and a second portion exposed to a second property. The first property is different from the second property causing the property-transferring material to develop micro-cyclic property transfer between the first and second properties. The first and second properties each include at least one of heat and mass. In one embodiment, the material is hydrophilic material. In another embodiment, the material is hydrophobic material. A property-changing device is associated with at least one of the carrier and the property-transferring material in particular embodiment of the invention. In yet a further embodiment, a property-changing device is associated with at least one of the first property and the second property. The first and second portions of the carrier can include first and second surfaces of the carrier, first and second extremities of the carrier, or a combination of one or more surfaces and one or more extremities of the carrier. The first property is carried by at least one fluid, or at least one solid, and the second property is carried by at least one fluid, or at least one solid.

According to the invention, a method includes providing a carrier supporting property-transferring material, exposing the property-transferring material to a first property at a first portion of the carrier, exposing the property-transferring material to a second property at a second portion of the carrier, the first property being different from the second property, and the property-transferring material developing micro-cyclic property transfer between the first and second properties in response to exposing the property-transferring material to the first property at the first portion of the carrier and to the second property at the second portion of the carrier. In one embodiment, the material is hydrophilic material. In another embodiment, the material is hydrophobic material. The method further includes associating a property-changing device with at least one of the carrier and the property-transferring material, and in a further embodiment associating a property-changing device with at least one of the first property and the second property. The first property is carried by at least one fluid, or at least one solid, and the second property is carried by at least one fluid, or at least one solid.

Consistent with the foregoing summary of preferred embodiments, and the ensuing detailed description, which are to be taken together, the invention also contemplates associated system/apparatus and method embodiments.

BRIEF DESCRIPTION OF THE DRAWINGS

Referring to the drawings:

FIG. 3 is a schematic representation of a gas-to-gas mass transfer system constructed and arranged in accordance with the principle of the invention;

FIG. 4 is a schematic representation of a gas-to-liquid heat and mass transfer system constructed and arranged in accordance with the principle of the invention;

DETAILED DESCRIPTION OF PREFERRED EMBODIMENTS

Figure 1:
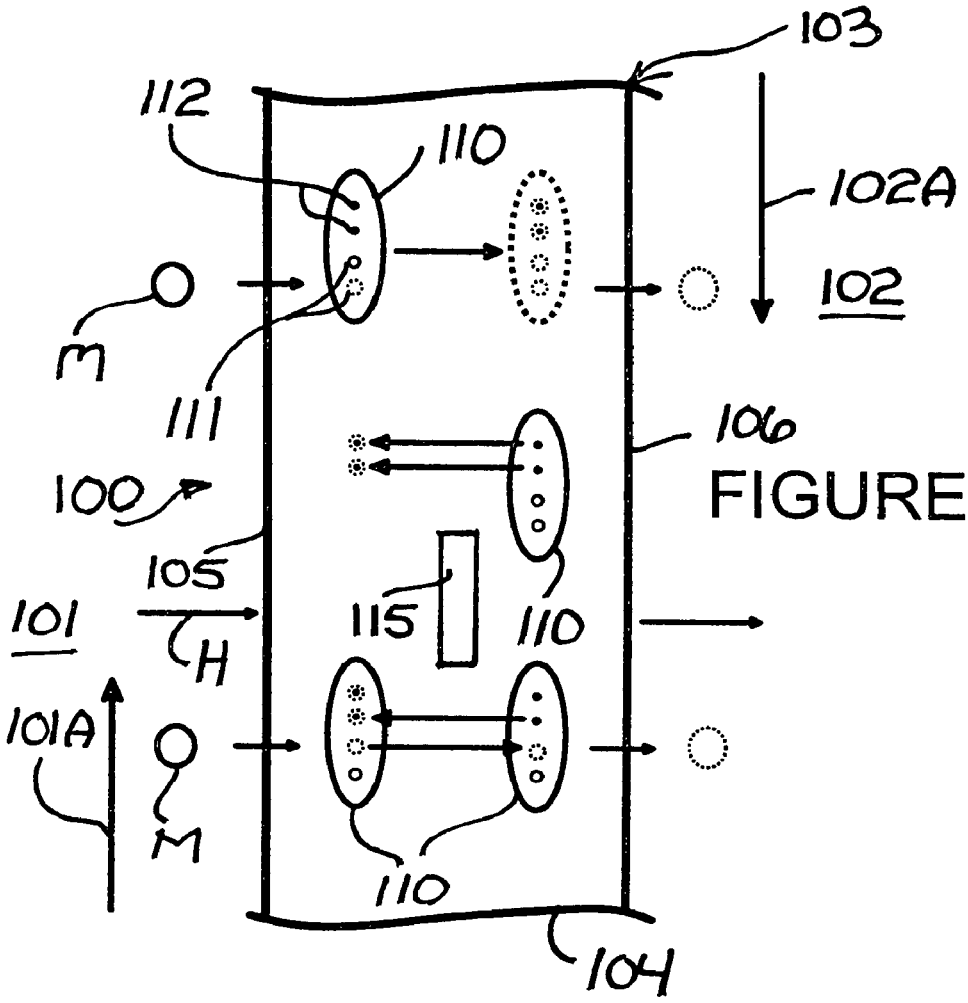
FIG. 1 is a schematic representation of gas-to-gas heat and mass transfer system constructed and arranged in accordance with the principle of the invention.

Disclosed herein are property-transferring systems and methods for transferring heat and/or mass between one or more substances, such as fluids and/or solids. The present invention employs property-transferring material supported by a carrier having opposing portions, such as opposing surfaces and/or opposing extremities. A first portion of the carrier is exposed to a first property and a second portion exposed to a second property. The first property is different from the second property, which, according to the principles of the invention, causes the property-transferring material to develop micro-cyclic property transfer between the first and second properties. The first and second properties each include at least one of heat and mass, at is it to be understood that the term "property" in this disclosure is intended to mean heat and/or mass (i.e., moisture). The first and second portions of the carrier can be opposing surfaces of the carrier, opposing extremities of the carrier, or one or more opposing surfaces and one or more opposing extremities. The first and second properties are each delivered or otherwise carried by a substance, such as one or more fluids and/or one or more solids. A fluid employed with the invention can be one or more liquids and/or one or more gases.

In a particular mode of the invention, the carrier is infused/permeated with material that is capable of transferring heat and/or mass between different substances, such as one or more fluids and/or solids. The substances, namely, the one or more fluids and/or solids, act as the heat and/or mass source and sink, according to the principle of the invention, and transferring heat and/or mass between substances changes the energy content of those substances. As previously mentioned, the fluids can be gases and/or liquids, and the solids can be a mass of solid particles, one or more blocks, bricks, slabs of rigid or semi-rigid materials, foam, wood, etc., in which energy, i.e. heat and/or mass, transfer therebetween is desired. A fluid used with the invention can be flowing, if desired. The property-transferring material is preferably in liquid form, in which the carrier is a liquid permeable substrate or combination of liquid-permeable substrates allowing the liquid property-transferring material to circulate therein in response to temperature and/or concentration fluctuations in the liquid property-transferring material due to exposure of the liquid property-transferring material to different properties at different portions of the substrate.

When the property-transferring material supported by the carrier is exposed to different properties at different portions thereof, it develops a micro-cyclic property transfer in which the property content of the two properties, which are each carried by one or more fluids and/or solids, change and, moreover, are essentially equalized. In other words, the property change to one of the properties is balanced by a corresponding change to the other property. Although the invention is particularly useful for transferring energy between two properties, it can be employed for transferring energy between three or more properties, in which the summation of the property contents of the properties are essentially equalized by way of the property-transferring material supported by the carrier. Altering the heat, composition or concentration, and/or flow characteristics of a property-transferring material employed in a carrier in accordance with the invention serves to alter the property-transferring properties of a property-transferring system constructed and arranged in accordance with the principles of the invention. In particular, the property-transferring material can be heated or cooled before being applied to the carrier. Alternatively, the carrier can be furnished with a heating and/or cooling unit, such as heating and/or cooling coils, for heating and/or cooling the property-transferring material after it is applied to the carrier, in accordance with the principles of the invention. The amount and/or type of property-transferring material can be varied, as can the type of carrier employed. The carrier and/or the property-transferring material can be provided to accept a specific property and reject another. A carrier of a property-transferring system constructed in accordance with the invention allows exchange of the property-transferring material between the two properties applied to the different portions of the carrier.

Referring now to the drawings, in which like reference characters indicate corresponding elements throughout the several views, attention is first directed to FIG. 1 in which there is seen a property-transferring system 100 for transferring heat and mass between substances including a carrier 103 interposed between the two substances, which, in the immediate embodiment, consist of air streams 101 and 102. Carrier 103 is a liquid permeable substrate 104 having one portion facing air stream 101 and an opposing portion facing air stream 102. In this specific example, the portion facing air stream 101 consists of a surface or side 105 of carrier 103, and the portion facing air stream 102 consists of an opposing surface or side 106 of carrier 103.

Air streams 101 and 102 are each developed by one or more fans, blowers, and/or air handlers (not shown), and flow counter currently relative to one another, in which air stream 101 flows in the direction as indicated by the arrowed line denoted at 101A and air stream 102 flows in the opposite direction as indicated the arrowed line denoted at 102A. It is to be understood that carrier 103 and air streams 101 and 102 may be maintained in a housing of, for instance, an air handling or conditioning system, in which carrier 103 is mounted in place, and air streams 101 and 102 are contained, for instance, in ducts or conduit structures or channels on either side of carrier 103 such that air streams 101 and 102 contact and move or flow over and across sides 105 and 106, respectively, of carrier 103.

According to the invention, substrate 104 is wetted with a property-transferring material that is capable of transferring heat and mass from air stream 101 to air stream 102 through substrate 104. The property-transferring material is in the form of a liquid, and in this embodiment consists of a liquid desiccant 110.

Liquid desiccant 110 is hydrophilic/hygroscopic, and can be a single liquid desiccant or a mixture of different liquid desiccants. Suitable liquid desiccants useful with the invention include, as a matter of example, lithium bromide, lithium chloride, a saline solution, or other similar hydrophilic liquid/solution or combination of hydrophilic liquids/solutions. It is to be understood that the term "liquid desiccant" is intended to include not only a single liquid desiccant but also a mixture of two or more liquid desiccants. When wetted with liquid desiccant 110, substrate 104 supports liquid desiccant 110, in which the liquid permeable character of substrate 104 permits liquid desiccant 110 to move/circulate there through from side 105 to side 106. The combination of substrate 104 and the infusion thereof with liquid desiccant 110 together create a dividing wall or partition dividing and isolating air streams 101 and 102 and preventing them from mixing and interacting with one another, in accordance with the principle of the invention.

Air streams 101 and 102 have different heat and mass contents, and thus have different energies. Moisture in a stream of fluid, whether gas or liquid, is commonly referred to as "mass" by those skilled in the art, and the term "mass" is used herein to defining the property of moisture. In the present embodiment, the heat and mass contents of air stream 101 are greater than the heat and mass contents of air stream 102. Liquid desiccant 110, which permeates substrate 104, consists of a solution of water and salt present at a predetermined concentration, in which the water is denoted at 111, and the salt is denoted at 112, and this is a common characteristic among desiccant liquids/solutions.

Air streams 101 and 102 flow against sides 105 and 106 of substrate 104, and interact with liquid desiccant 110 carried by substrate 104 at sides 105 and 106, respectively. Because the heat and mass content of air stream 101 is greater than the heat and mass content of air stream 102, an energy imbalance exists across substrate 104, and liquid desiccant 110 interacting with air stream 101 at side 105 of substrate 104 picks up heat H and mass M from air stream 101, which heats and also weakens the concentration of the liquid desiccant 110 at side 105 relative to that of the liquid desiccant 110 at side 106. As a result of this temperature and concentration differential/imbalance of liquid desiccant 110 across substrate 104 from side 105 to side 106, which is created by the energy imbalance across substrate 104 caused by the different properties of air streams 101 and 102 interacting with liquid desiccant 110 at sides 105 and 106, the liquid desiccant 110 at side 105 becomes diluted/hypotonic and the liquid desiccant 110 at side 106 becomes correspondingly concentrated/hypertonic. As a result, water 111 will diffuse/flow from the "hypotonic" side 105 of substrate 104 to the "hypertonic" side 106 of substrate 104 to equalize the concentration differential, and salt 112 will diffuse/flow from the "hypertonic" side 106 of substrate 104 to the "hypotonic" side 105 of substrate 104 to equalize the concentration differential.

The water 111 that flows from side 105 of substrate 104 to side 106 of substrate 104 carries the heat and mass picked up from air stream 101. When the water 111 carrying the heat and mass picked up from air stream 101 reaches side 106, air steam 102 comes into contact with this water at side 106 and interacts with it, in which the colder drier air stream 102 will pick up the heat and mass transferred to side 106 of substrate from side 105 of substrate 104. According to the invention, liquid desiccant 110 in substrate 104 transfers heat and mass from hotter moisture air stream 101 to colder drier air stream 102, in which air stream 101 is cooled and dried and air stream 102 is heated and moisturized, in accordance with the principle of the invention.

When the water 111 that picked up the heat and mass from air stream 101 reaches side 106, the water momentarily dilutes the hypertonic side 106 of substrate 104, and also releases its heat and mass into air stream 102 from side 106, which relieves this momentary dilution of the hypertonic side 106 of substrate 104. When the momentary dilution of the hypertonic side 106 of substrate 104 occurs, salt 112 diffuses/flows from side 105 of substrate 104 to side 106 of substrate and water flows in the opposite direction, which essentially recharges the system so that the heat and mass transfer function facilitated by liquid desiccant 110 can continue to occur in this cyclic nature.

And so as the hotter moister air of air stream 101 continues to flow across side 105 of substrate 104 interacting with liquid desiccant 110, and the cooler drier air of air stream 102 continues to flow across side 106 of substrate 104, substrate 104, which is permeable to liquid desiccant 110, and liquid desiccant 110 together function as an engine continually and cyclically transferring heat and mass from hotter moisture air stream 101 to colder drier air stream 102, in accordance with the principle of the invention. Accordingly, air stream 101 is cooled and dried with system 100, and air stream 102 is heated and moisturized with system 100. After having been conditioned with system 100, air stream 101 can be directed through an outlet into, for instance, a habitable structure for providing cooling air, in which air stream 102 may be discharged through an outlet into the environment as "waste." Prior to entering a habitable structure, air stream 101 may be further conditioned, i.e., heated or cooled, by a selected heat transfer apparatus, such as a compressor or other heat-transfer apparatus or system. Alternatively, after having been conditioned with system 100, air stream 102 can be directed through an outlet into, for instance, a habitable structure for providing heating air, in which air stream 101 may be discharged through an outlet into the environment as "waste." Prior to entering a habitable structure, air stream 102 may be further conditioned, i.e., heated or cooled, by a selected heat transfer apparatus, such as a compressor or other heat-transfer apparatus or system. Air streams 101 and 102 conditioned with system 100 can be used for any desired purpose, such as heating, cooling, scientific purposes, etc.

In FIG. 1 it is seen that air streams 101 and 102 run countercurrently relative to one another. Air streams 101 and 102 can run concurrently relative to one another, if desired, which will have no bearing on the function of system 100. Also, although two air streams are interacting with carrier 103 in system 100, system 100 can be facilitated with more than two air streams, if desired.

According to the principles of the invention, the invention provides infusing a liquid permeable carrier 103 with a liquid desiccant for providing a foundation for the development of micro-cyclic heat and mass transfer regions along carrier 103 when opposing sides 105 and 106 of carrier 103 are exposed to air streams containing an unequal energy content, in which the energy content of the air streams is defined by differing heat and mass contents of the air streams in the embodiment designated 100. The micro-cycles are developed by liquid desiccant 110 across carrier 103, and are discrete areas along carrier 103 in which heat and mass transfer events from side 105 of substrate 104 to side 106 of substrate 104 take place. Streams 101 and 102 can be at atmospheric pressure, at high pressure, and can also be present in a vacuum, in which each such condition impacts the rate and nature of property transfer. Although the fluids in the embodiment designated at 100 are in the form of streams, one of or each of the fluids can be still as in the form of a layer, if desired, and it will be understood that this applies to all ensuing embodiments utilizing fluid streams. The fluids can be at high or low temperatures, and may be provided in different volumes or flow rates, and this also applies to all ensuing embodiments utilizing fluid streams.

The occurrence of micro-cycles is unique and caused by the circulation of liquid desiccant 110 through carrier 103 from side 105 to side 106 (i.e., the circulation of water and salt ions back and forth through carrier 103 from side 105 to side 106), are random, self-inducing, and self-circulating along the extent of carrier 103, and have no defined direction other than circulation. The micro-cycles are induced by a combination of diffusion or capillary force and salt or ion diffusion caused by the combination of temperature differentials in liquid desiccant 110 across carrier 103, concentration variances in liquid desiccant 110 as it picks up mass from one air stream and transfers it to another drier air stream, the coincident surface tension differentials of liquid desiccant 110 at sides 105 and 106, and, in certain instances, gravitational forces.

And so micro-cycles refer to random self-induced cycles of property-transferring materials within a carrier driven by forces resulting from the difference of properties of the substance and/or other natural forces, including, but not necessarily limited to, capillary forces, diffusion forces, temperature-induced pressure variances, gravity, etc. In a carrier permeated with liquid that is exposed to gas streams in accordance with the principle of the invention, the liquid acts as a property-transferring material that develops micro-cycles caused by capillary force and diffusion. In a carrier permeated with gas that is exposed to liquids in accordance with the principle of the invention, the gas acts as a property-transferring material that develops micro-cycles caused by pressure differentials due to temperature differentials and diffusion. In this regard, in a situation in which property-transfer is desired between two substances, the property-transferring material in the carrier can be a gas.

Capillary force is related to the surface tension of liquid desiccant 110 and to the temperature and concentration of liquid desiccant 110. A temperature change or concentration change in liquid desiccant 110 develops a capillary force change and, thus, a micro-cycle, namely, a micro-cyclic heat and mass transfer event. In accordance with system 100, air stream 101 increases the temperature of liquid desiccant 110 at side 105 and lowers its concentration as it picks up heat and mass from air stream 101. This increase in temperature and decrease in concentration of liquid desiccant 110 at side 105 reduces the surface tension of liquid desiccant 110, which causes water 111 to move through carrier 103 from side 105 to side 106 thus coming into contact with air stream 102. The resulting diffusion force caused by the resulting concentration differential of liquid desiccant 110 causes salt (i.e., ion) exchange from side 106 of carrier 103 to side 105 of carrier 103. In sum, this water and salt or ion transfer back and forth across carrier 103 from side 105 to side 106 caused as a result of exposure of sides 105 and 106 to air streams having different energy properties or contents produces in carrier 103 and liquid desiccant 110 it supports a heat and mass transfer engine, in accordance with the principle of the invention.

As a further example, a cool and dry air stream would decrease the temperature of the liquid desiccant, lower its concentration, and reduce its surface tension. In this example, the desiccant is caused to circulate through the carrier in contact with the colder and dryer air stream and dry by means of capillary force. A diffusion force causing ion exchange is created owing to carrier contact with the colder air stream. The desiccant, now colder and with a higher concentration, will provide for ion diffusion through the carrier to contact the cooler desiccant of lower concentration.

It will be understood that although system 100 is described in an environment in which air stream 101 has an initial heat and mass content which is greater than the initial heat and mass content of air stream 102, system 100 will work equally well in the environment in which air stream 101 has an initial heat and mass content which is less than the initial heat and mass content of air stream 102, in which case the operation of system 100 is reversed. Furthermore, the heat transfer function of liquid desiccant 110 and the mass/moisture transfer function of liquid desiccant 110 can work independently from one another. In this respect, liquid desiccant 110 functions to transfer heat from a hotter stream of air, namely, air stream 101, to a colder stream of air, namely, air stream 102, and this function is carried out by liquid desiccant 110 regardless of the mass/moisture difference between the respective air streams. Moreover, liquid desiccant 110 functions to transfer mass/moisture from a moist stream of air, namely, air stream 101, to a drier stream of air, namely, air stream 102, and this function is carried out by liquid desiccant 110 regardless of the temperature/heat difference between the respective air streams.

Property change to one fluid stream exiting the carrier will balance the property change to the other fluid stream also exiting the carrier. In cases utilizing two or more fluid streams, the summation of property content entering the system from all fluid streams will equal the summation of property content of the fluid steams exiting the system. In order to add or subtract energy, an external energy or property-changing source can be provided. This energy change may be one or more of a change in the temperature of the property-transferring material, a change in the composition of the property-transferring material, a change in the flow of the property-transferring material through the carrier, and change in the flow of the fluid streams interacting with the property-transferring material supported by the carrier, and/or a property change one or more of the fluid streams. To create an imbalance in the property change to the fluid steams utilized in the system, one or more auxiliary energy sources can be provided, including one to heat and or cool one or more of the fluids applied to the system, and/or to heat and or cool the property-transferring substance supported by the carrier. Also, the flow of the property-transferring material on one portion of the carrier can be greater than a flow of the property-transferring material on an opposing portion of the carrier. Again, the energy change may be a change in the temperature of the property-transferring material, and/or a change in the composition of the property-transferring material, and/or a change in the flow rates of property-transferring material at different parts of the carrier. Furthermore, in addition to changing the temperature or concentration of the property-transferring material, energy may also be imparted by utilization of direct temperature change, such as associating a heat exchange device with the carrier. As a matter of illustration, a heat exchange device 115, such as a heat transfer coil or the like, is associated with carrier 103 in FIG. 1, which can be activated and used to heat and/or cool the property-transferring material supported by carrier 103. Although only one heat transfer device is incorporated with carrier 103, more can be provided, if desired. One or more heat transfer device can be incorporated with the carriers of the ensuing embodiments of the invention to be presently discussed, if desired.

Substrate 104 can be provided in various forms and structural configurations, including one or more of a relatively flat sheet or membrane, an elongate member, an elongate generally tubular member, a disk, a sphere, a combination of two or more of the foregoing substrate forms, etc. Substrate 104 is preferably substantially self-supporting. Sides 105 and 106 can be corrugated, if desired, for maximizing the surface area of each in contact with the fluid streams. Substrate 104 is fashioned of a liquid permeable material, or combination of liquid-permeable materials, and is liquid absorbent, relatively rugged and not easily damaged, capable of withstanding pressure differentials, and can withstand prolonged exposure to property-transferring materials and periodic wash-downs or cleanings with cleansing fluids. Suitable materials that can be used for substrate 104 include, treated paper or cellulosic material, permeable plastic, high-density foam material, high-density mesh material, a matrix of woven and/or unwoven polyester, polyethylene, or like material, or combination of any of the foregoing materials or similar materials. The substrate can be formed as an integral component, or as a combination of different materials that are joined together. The substrate could be a sandwich or laminate structure, and can be configured with different materials, such as netting and/or corrugated spacers, etc., for favoring heat transfer, or for favoring mass transfer. The substrate can also be made of different materials over its length, such as a one or more sections favoring heat transfer and one or more sections favoring mass transfer. Also, the portions of the substrate at which the different properties interact with the property-transferring material can be treated to reduce surface tension or to increase surface tension, which will alter the rate or quality of property transfer through the carrier as will be presently described.

Substrate 104 is a single component, which characterizes carrier 103 in the immediate embodiment. Carrier 103 can be configured as a combination of separate substrates, if desired, such as a plurality of substrate sheets, modules, components, elongate members, etc. A carrier can also be configured in multiple-tubular formats such that one or more fluid streams is contained within a series of tubular confines. A carrier can be continuous along its length, or can be broken up in to a plurality of substrate sections divided by non-property transferring spacers, dividers, blocks, partitions, etc.

The property-transfer characteristic of the property-transferring material applied to the carrier as in the embodiment designated 100 can be controlled by the type of property-transferring material used, by using a plurality of different property-transferring materials, in which the term "material" is intended to include a single property-transferring material or a combination of different property-transferring materials, including even different compositions of the same material. The portions of the carrier at which property transfer takes place can furnished with different amounts of the same property-transferring material, different compositions of the same property-transferring material, or different property-transferring materials. Application of property-transferring material to the carrier can be provided by forced distribution, and the carrier can be replenished with property-transferring material on a continuous basis, or a periodic basis. If the property-transferring material is applied by forced distribution, different portions of the carrier can be provided with different levels of the property-transferring material for controlling its property-transfer characteristic.

Distribution of a property-transferring material to a carrier in a system constructed and arranged in accordance with the principle of the invention can be made with a wicking system, in which a portion of the carrier is disposed in the property-transferring material such that it wicks into the carrier. The carrier can be furnished with wicking material or a combination of wicking materials for enhancing the desired wicking effect, and various wicking structures may be used, including metal powder and the like.

Further embodiments of the invention will now be discussed. It is to be understood that the general principles of the invention discussed in conjunction with system 100 also apply to the ensuing embodiments.

Figure 2:
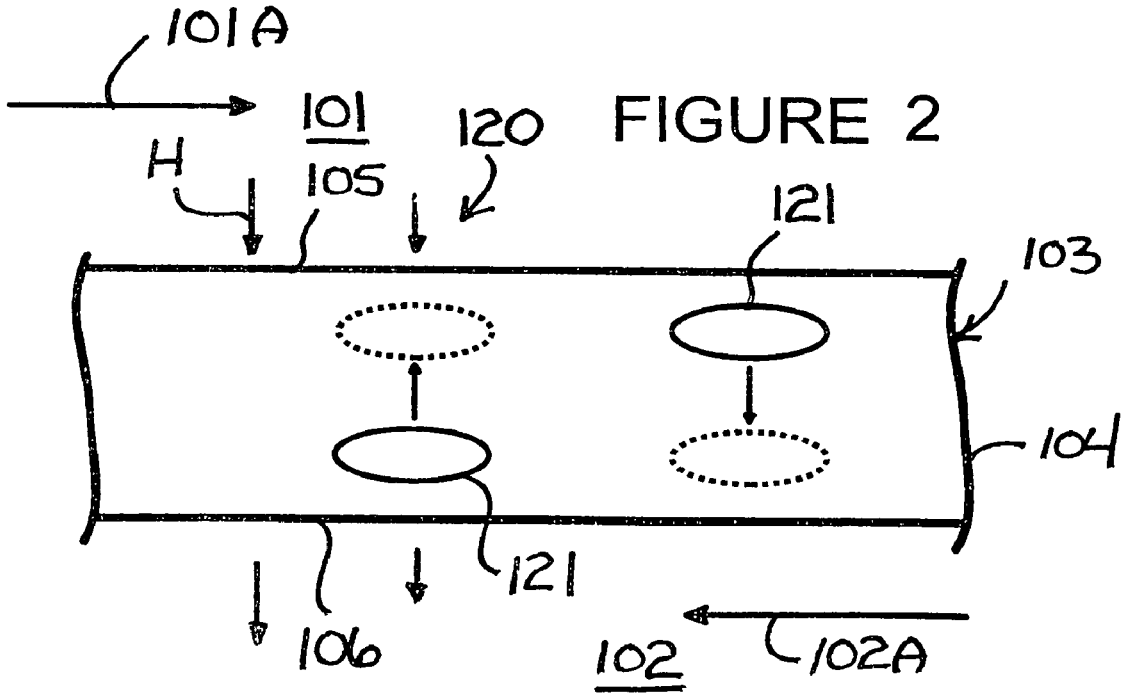
FIG. 2 is a schematic representation of a gas-to-gas heat transfer system constructed and arranged in accordance with the principle of the invention.

Referring now to FIG. 2, a system 120 for transferring heat between air streams is shown, which, in common with system 100, shares carrier 103 including substrate 104 and sides 105 and 106, air stream 101, and air stream 102. Unlike system 100 discussed in conjunction with FIG. 1, substrate 104 is wetted with a hydrophobic liquid 121. Hydrophobic liquid can be a single hydrophobic liquid or a combination of different hydrophobic liquids. A suitable and preferred hydrophobic liquid is silicone oil, and other hydrophilic oils/liquids or selected combination of hydrophilic oils/liquids may be used if desired. It is to be understood that the term "hydrophobic liquid" is intended to include not only a single hydrophobic liquid but also a mixture of two or more hydrophobic liquids.

When wetted with hydrophobic liquid 121, substrate 104 acts as a carrier or support structure for hydrophobic liquid 121, in which the liquid permeable character of substrate 104 permits hydrophobic liquid to move/circulate there through from side 105 to side 106. The infusion of hydrophobic liquid 121 in substrate 104 together create a dividing wall or partition which divides and isolates air streams 101 and 102 and prevents them from mixing and interacting with one another, in accordance with the principle of the invention.

Like system 100, air streams 101 each contain two properties, namely, heat and mass, i.e., moisture. The heat and mass contents of air stream 101 are greater than the heat and mass contents of air stream 102, although the mass contents of air streams 101 and 102 really have no bearing in system 120. Air streams 101 and 102 flow against sides 105 and 106 of substrate 104, and interact with hydrophobic liquid 121 carried by substrate 104 at sides 105 and 106, respectively. Because the heat and mass content of air stream 101 is greater than the heat and mass content of air stream 102, an energy imbalance exists across substrate 104 and hydrophobic liquid 121 interacting with air stream 101 at side 105 of substrate 104 picks up only heat H from air stream 101 becoming hot relative to hydrophobic liquid 121 at side 106, which develops a temperature differential in hydrophobic liquid 121 across substrate 104 from side 105 to side 106 and causing the hydrophobic liquid 121 at side 105 to wick across substrate 104 from side 105 to side 106. The hydrophobic liquid 121 that wicks/flows from side 105 of substrate 104 to side 106 of substrate 104 carries the heat picked up from air stream 101, but not moisture do to its hydrophobic character, namely, its lack of affinity for water. When the hydrophobic liquid 121 carrying the heat picked up from air stream 101 reaches side 106, air steam 102 comes into contact with this heated hydrophobic liquid 121 and interacts with it. Because the heat content of air stream 101 is greater than that of air stream 102, the colder air stream 102 will pick up the heat from the hydrophobic liquid 121 transferred to side 106 of substrate from side 105 of substrate 104. According to the invention, hydrophobic liquid 121 in substrate 104 functions to transfer heat from hotter air stream 101 to colder stream 102, in which air stream 101 is cooled and air stream 102 is heated, in accordance with the principle of the invention. Because system 120 utilizes a hydrophobic liquid 121, hydrophobic liquid 121 rejects moisture and will not transfer moisture between air streams 101 and 102. As hot hydrophobic liquid 121 wicks from side 105 to the colder hydrophobic liquid 121 at side 106, the colder hydrophobic liquid at side 106 is displaced and is forced to side 105, which essentially recharges the system.

And so as the hotter air of air stream 101 continues to flow across side 105 of substrate 104 interacting with hydrophobic liquid 121, and the cooler air of air stream 102 continues to flow across side 106 of substrate 104, substrate 104, which is permeable to hydrophobic liquid 121, and hydrophobic liquid 121 function as micro-cyclic heat-transfer engine continually transferring heat from hotter air stream 101 to colder air stream 102 as heated and cooled hydrophobic liquid circulates through carrier 103 from side 105 to side 106, in accordance with the principle of the invention. Air stream 101 is cooled with system 120, and air stream 102 is heated with system 100.

According to the principles of the invention, the invention provides infusing a liquid permeable carrier 103 with a hydrophobic liquid for providing a foundation for the development of micro-cyclic heat transfer regions along carrier 103 when opposing sides 105 and 106 of carrier 103 are exposed to air streams containing an unequal energy content, in which the energy content of the air streams is defined by differing heat contents of the air streams in the embodiment designated 120. The micro-cycles are developed by hydrophobic liquid 121 across carrier 103, and are discrete areas along carrier 103 in which heat transfer events from side 105 of substrate 104 to side 106 of substrate 104 take place as hot and cold hydrophobic liquid 121 circulates back and forth through carrier 103 from side 105 to side 106.

It will be understood that although system 120 is described in an environment in which air stream 101 has an initial heat content which is greater than the initial heat content of air stream 102, system 120 will work equally well in the environment in which air stream 101 has an initial heat content which is less than the initial heat content of air stream 102, in which case the operation of system 120 is reversed.

Reference is now made to FIG. 3, in which there is seen a system 140 for transferring mass between two opposing air streams 141 and 142 including a carrier 143 interposed between air streams 141 and 142. In this exemplary embodiment, carrier 143 is a substrate 144 that consists of united, superimposed layers including a central layer 145 and two opposing outer layers 146 and 147. Layer 146 has a face or side 148 facing air stream 141, and layer 147 and a face or side 149 facing air stream 142.

Air streams 141 and 142 are each developed by one or more fans, blowers, and/or air handlers (not shown) and flow counter currently relative to one another, in which air stream 141 flows in the direction as indicated by the arrowed line denoted at 141A and air stream 142 flows in the opposite direction as indicated the arrowed line denoted at 142A. Air streams 141 each contain two properties, namely, heat and mass. The heat and mass contents of air stream 141 defining the energy content of air stream 141 are greater than the heat and mass contents of air stream 142 which define its energy content. Carrier 143 and air streams 141 and 142 are maintained in a housing of an air handling or conditioning system, in which carrier 143 is mounted in the housing and air streams 141 and 142 contained, for instance, in ducts on either side of carrier 143 such that air streams 141 and 142 contact and move or flow over sides 148 and 149, respectively, of carrier 143.

Substrate 144, which constitutes carrier 143 in this embodiment, is fashioned of a combination of liquid permeable materials. According to the invention, substrate 144 is wetted with material that is capable of transferring heat and mass from air stream 141 to air stream 142 through substrate 144. In the present embodiment, the material is liquid desiccant 160. Liquid desiccant 160 is similar to liquid desiccant 110, and it is to be understood that the discussion of desiccant 110 applies to desiccant 160. When wetted with liquid desiccant 160, substrate 144 acts as a carrier or support structure for liquid desiccant 160. The infusion of liquid desiccant 160 in substrate 144 together create a dividing wall or partition which divides and isolates air streams 141 and 142 and prevents them from mixing and interacting with one another, in accordance with the principle of the invention.

Layers 146 and 147 and wick layers 161 are each fashioned of a liquid permeable material or a combination of materials like that of substrate 104, and layer 145 is fashioned of alternating wick layers 161 and insulator layers 162, in which wick layers 161 provide wicking passages for liquid desiccant 160 to circulate between layers 146 and 147, and insulator layers 162 absorb heat substantially preventing heat transfer through substrate 144, in accordance with the principle of the invention. Insulator layers 162 are fashioned of an insulating material or combination of materials, such as ceramic material or other heat-absorbing material or combination of heat-absorbing materials. With the exception of insulator layers 162 substantially preventing heat transfer through substrate 144, system 140 functions identically to system 100 transferring moisture from a moist air stream to a drier air stream, in which the discussion of system 100 applies to system 140 in this regard. However, because insulator layers 162 absorb heat and thereby substantially prevent heat transfer through substrate 144, system 140 transfers only mass (i.e., moisture) between air streams 141 and 142, in accordance with the principle of the invention. It will be readily understood that carrier 143 is configured to reject heat transfer, and facilitate mass transfer.

Air streams 141 and 142 flow against sides 148 and 149 of substrate 144, and interact with liquid desiccant 160 carried by substrate 144 at sides 148 and 149, respectively. Because the heat and mass content of air stream 141 is greater than the heat and mass content of air stream 142, an energy imbalance exists across substrate 144 and liquid desiccant 160 interacting with air stream 141 at side 148 of substrate 144 picks up heat and mass M from air stream 141, which weakens the concentration of liquid desiccant 160 at side 148 relative to the concentration of liquid desiccant 160 at side 149. As a result of this concentration differential of liquid desiccant 160 across substrate 144 which is created by the energy imbalance across substrate 144 caused by the different properties of air streams 141 and 142 interacting with liquid desiccant 160 at sides 148 and 149, liquid desiccant 160 at side 148 becomes diluted/hypotonic and the liquid desiccant 160 at side 149 becomes correspondingly concentrated/hypotonic. As a result, the water of liquid desiccant 160 will diffuse/flow through wick layers 161 from the "hypotonic" side 148 of substrate 144 to the "hypertonic" side 149 of substrate 144, and the salt of liquid desiccant 160 will diffuse/flow through wick layers 161 from the "hypertonic" side 149 of substrate 144 to the "hypotonic" side 148 of substrate 104.

The water that flows from side 148 of substrate 144 to side 149 of substrate 144 carries the heat and mass picked up from air stream 141. As the water carrying the heat and mass picked up from air stream 141 passes through wick layers 161, insulator layers 162 absorb the heat carried by the water in which the concentration differential in liquid desiccant 160 across substrate 144 maintains the flow of the water into layer 147 and air steam 102 comes into contact with this water and interacts with it and picks up the mass transferred from air stream 141. According to the invention, liquid desiccant 160 in substrate 144 functions to transfer mass from hotter moisture air stream 141 to colder drier air stream 142, in which insulator layers 162 prevent heat transfer between air streams 141 and 142 and air stream 141 is cooled and dried and air stream 142 is moisturized, in accordance with the principle of the invention.

When the water 111 that picked up the mass from air stream 141 reaches side 149, the water momentarily dilutes the hypertonic side 149 of substrate 144, and also releases its mass into air stream 142 from side 149, which relieves this momentary dilution of the hypertonic side 149 of substrate 144. When the momentary dilution of the hypertonic side 149 of substrate 144 occurs, the salt of liquid desiccant 160 diffuses/flows from side 149 of substrate 144 to side 148 of substrate and water flows in the opposite direction, which essentially recharges the system so that the mass transfer function facilitated by liquid desiccant 160 can continue to occur in this cyclic or micro-cyclic nature.

And so as the hotter moister air of air stream 141 continues to flow across side 148 of substrate 144 interacting with liquid desiccant 160, and the cooler drier air of air stream 142 continues to flow across side 149 of substrate 144, substrate 144 and liquid desiccant 160 function as an engine continually and cyclically pulling heat and mass out of air stream 141, and transferring mass from hotter moisture air stream 141 to colder drier air stream 142 via wick layers 161 and absorbing heat via insulator layers 162, in accordance with the principle of the invention. Accordingly, air stream 141 is cooled and dried with system 140, and air stream 142 is moisturized with system 100.

It will be understood that although system 140 is described in an environment in which air stream 141 has an initial heat and mass content which is greater than the initial heat and mass content of air stream 142, system 140 will work equally well in the environment in which air stream 141 has an initial heat and mass content which is less than the initial heat and mass content of air stream 142, in which case the operation of system 140 is reversed.

In FIG. 3 it is seen that air streams 141 and 142 run countercurrently relative to one another. Air streams 141 and 142 can run concurrently relative to one another, if desired, which will have no bearing on the function of system 140.

According to the principles of the invention, the invention provides infusing a liquid permeable carrier 143 with a liquid desiccant for providing a foundation for the development of micro-cyclic mass transfer regions along carrier 143 when opposing sides 148 and 149 of carrier 143 are exposed to air streams containing an unequal energy content, in which the energy content of the air streams is defined by differing heat and mass contents of the air streams in the embodiment designated 140. The micro-cycles are developed by liquid desiccant 160 across carrier 143, and are discrete areas along carrier 143 in which heat and mass transfer events from side 148 of carrier 143 to side 149 of carrier 143 take place, in which wick layers 161 in carrier 143 permit mass transfer between sides 148 and 149 of carrier 143 and insulator layers 162 in carrier 143 substantially prevent heat transfer between sides 148 and 149 of carrier 143.

Reference is now made to FIG. 4 a system 180 for transferring heat and mass between an air stream and a liquid stream is shown, which, in common with system 100 discussed in conjunction with FIG. 1, shares carrier 103 including substrate 104 and sides 105 and 106, liquid desiccant 110, and air stream 101 flowing along side 105. Unlike system 100, air stream 102 in system 100 is replaced with a liquid stream 181, which can be a stream of aqueous material. Air stream 101 and liquid stream 181 flow counter currently relative to one another, in which air stream 101 flows in the direction as indicated by arrowed line 101A and liquid stream 181 flows in the opposite direction as indicated the arrowed line denoted at 181A. Streams 101 and 181 can flow concurrently relative to one another, if desired. Also, one or each of streams 101 and 181 can be still, as in the form of a layer, if desired.

Like system 100, carrier 103 is wetted with liquid desiccant 110, which is hydrophilic. System 180 functions identically to system 100, and the discussion of system 100 applies to system 180, with the exception that the heat and mass transfer in system 180 occurs between air stream 101 and liquid stream 181, rather than between air stream 101 and another air stream, such as air stream 102 as in system 100. Also, although an air stream and a liquid stream are interacting with carrier 103 in system 180, system 180 can be facilitated with more than two air and liquid streams, if desired.

Figure 5:
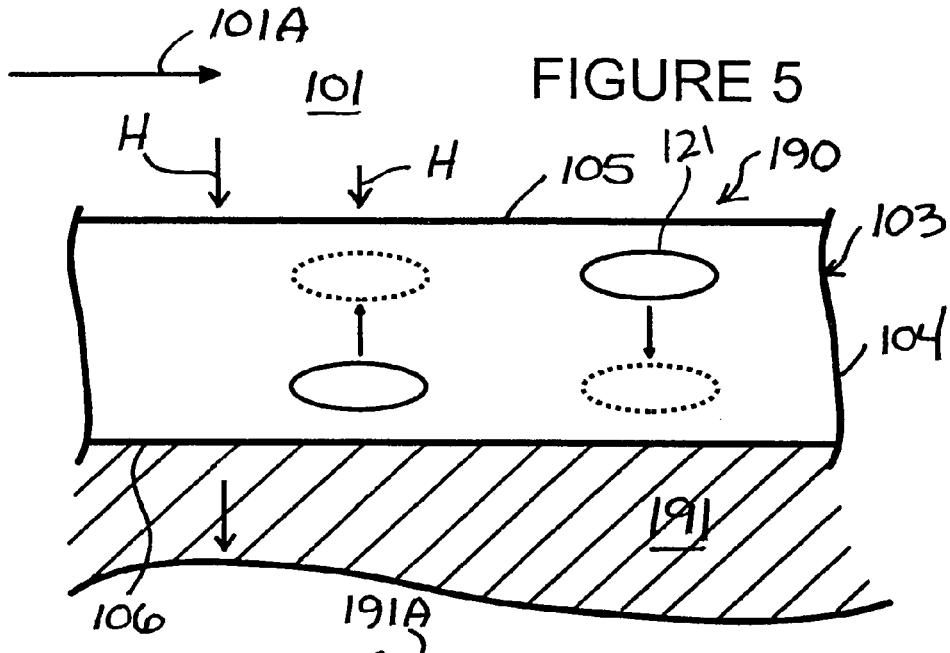
FIG. 5 is a schematic representation of a gas-to-liquid heat transfer system constructed and arranged in accordance with the principle of the invention.

Referring now to FIG. 5, a system 190 for transferring heat between an air stream and a liquid stream is shown, which, in common with system 120, shares carrier 103 including substrate 104 and sides 105 and 106, hydrophobic liquid 121, and air stream 101. Unlike system 120 discussed in conjunction with FIG. 2, air stream 102 in system 120 is replaced with a liquid stream 191 in system 190, which can be a stream of aqueous material. Air stream 101 and liquid stream 191 flow countercurrently relative to one another, in which air stream 101 flows in the direction as indicated by arrowed line 101A and liquid stream 191 flows in the opposite direction as indicated the arrowed line denoted at 191A. Streams 101 and 191 can flow concurrently relative to one another, if desired. Also, one or each of streams 101 and 191 can be still, as in the form of a layer, if desired.

Substrate 104 is wetted with hydrophobic liquid 121. So wetted with hydrophobic liquid 121, substrate 104 acts as a carrier or support structure for hydrophobic liquid 121, in which the liquid permeable character of substrate 104 permits hydrophobic liquid 121 to move/circulate therethrough from side 105 to side 106. The infusion of hydrophobic liquid 121 in substrate 104 together create a dividing wall or partition which divides and isolates air stream 101 from liquid stream 191 and prevents them from mixing and interacting with one another, in accordance with the principle of the invention. System 190 functions identically to system 120, and the discussion of system 120 applies to system 190, with the exception that the heat transfer in system 120 occurs between air stream 101 and liquid stream 191, rather than between air stream 101 and another air stream, such as air stream 102 as in system 100. Also, although an air stream and a liquid stream are interacting with carrier 103 in system 190, system 190 can be facilitated with more than two air and liquid streams, if desired.

Figure 6:
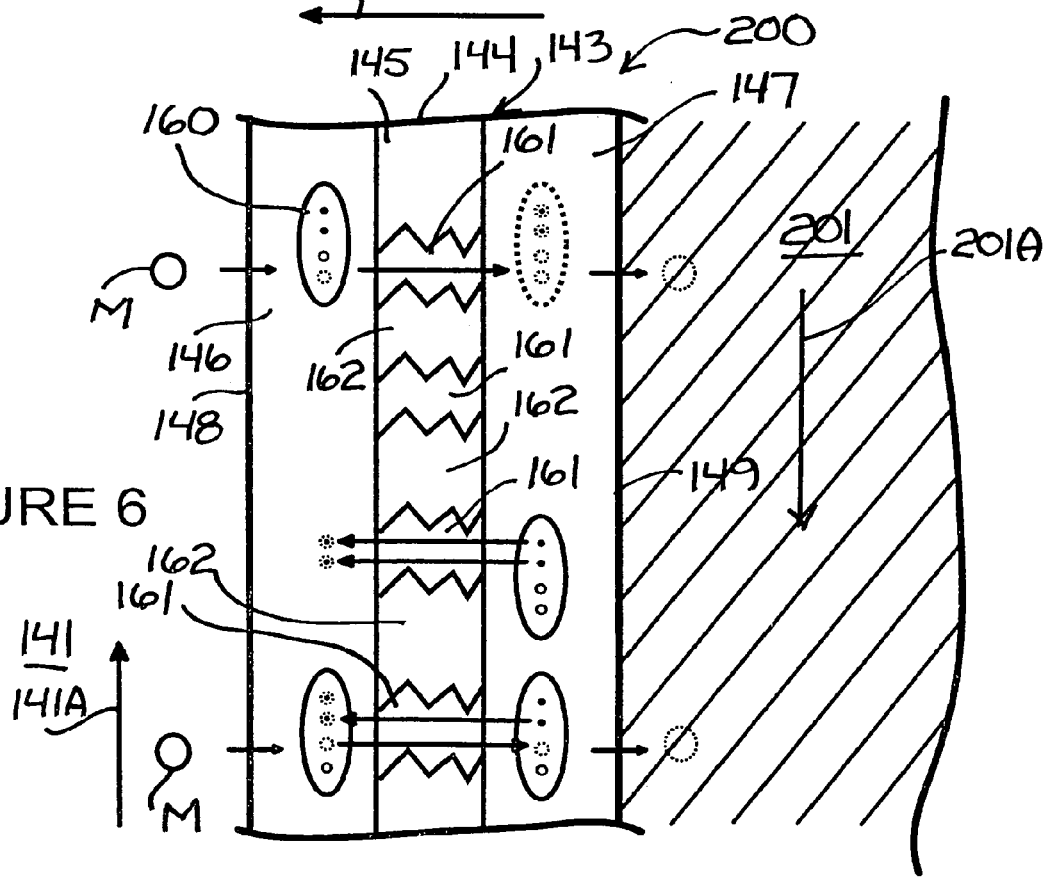
FIG. 6 is a schematic representation of a gas-to-liquid mass transfer system constructed and arranged in accordance with the principle of the invention.

Reference is now made to FIG. 6, in which there is seen a system 200 for transferring mass between an air stream and a liquid stream, which, in common with system 140, shares carrier 143 including substrate 144 with layers 145,146,147, sides 148 and 149, liquid desiccant 160, wick layers 161, insulator layers 162, and air stream 141. Unlike system 140 discussed in conjunction with FIG. 3, air stream 142 in system 140 is replaced with a liquid stream 201 in system 200, which can be a stream of aqueous material. Air stream 141 and liquid stream 201 flow countercurrently relative to one another, in which air stream 141 flows in the direction as indicated by arrowed line 141A and liquid stream 201 flows in the opposite direction as indicated the arrowed line denoted at 201A. Streams 141 and 201 can flow concurrently relative to one another, if desired. Also, one or each of streams 141 and 201 can be still, as in the form of a layer, if desired.

Substrate 144 is wetted with liquid desiccant 160. So wetted with liquid desiccant 160, substrate 144 acts as a carrier or support structure for liquid desiccant 160, and the infusion of liquid desiccant 160 in substrate 144 together create a dividing wall or partition which divides and isolates air stream 141 from liquid stream 201 and prevents them from mixing and interacting with one another, in accordance with the principle of the invention. System 200 functions identically to system 140, and the discussion of system 120 applies to system 200, with the exception that the heat transfer in system 200 occurs between air stream 101 and liquid stream 201, rather than between air stream 101 and another air stream, such as air stream 102 as in system 140. Also, although an air stream and a liquid stream are interacting with carrier 143 in system 200, system 200 can be facilitated with more than two air and liquid streams, if desired.

Figure 7:
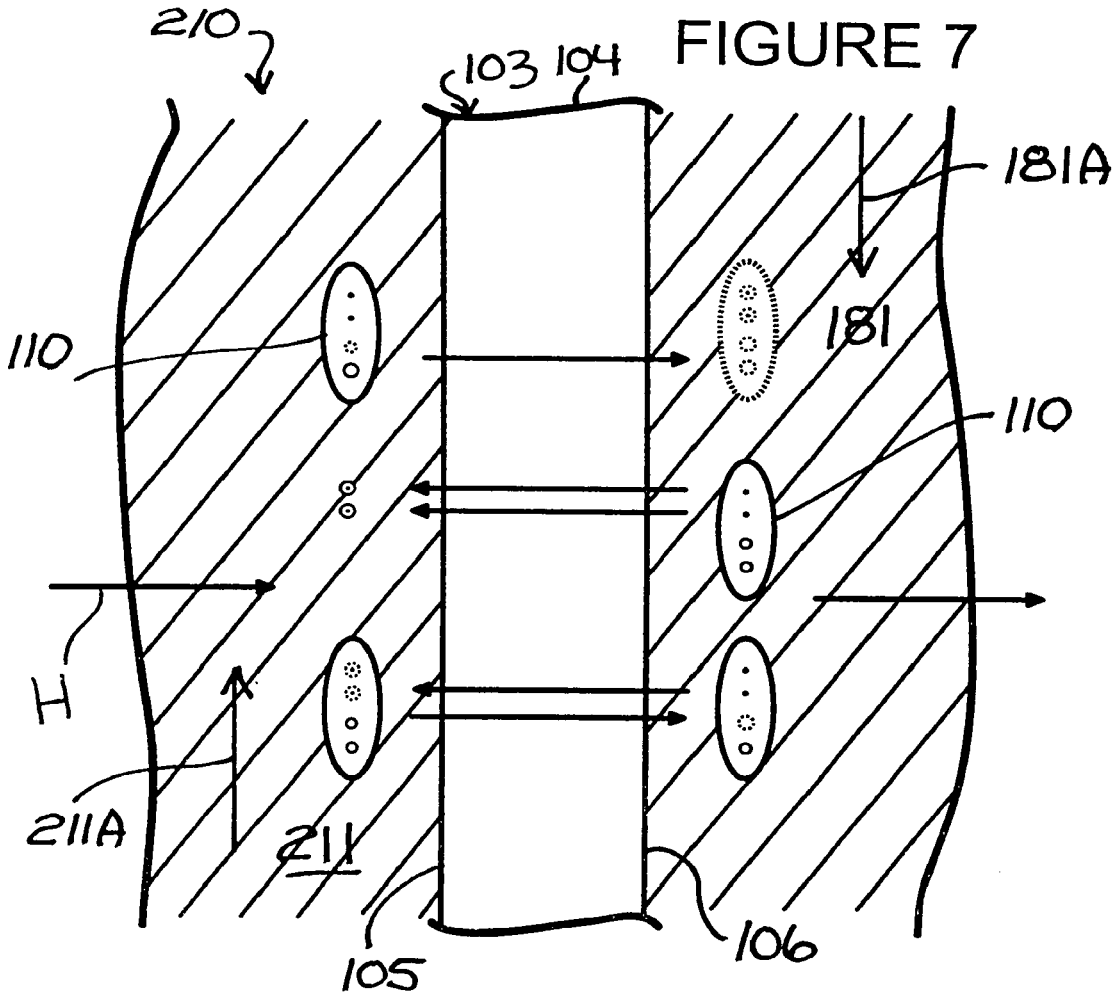
FIG. 7 is a schematic representation of a liquid-to-liquid heat and mass transfer system constructed and arranged in accordance with the principle of the invention.

Referring to FIG. 7, shown is a system 210 for transferring heat and mass between liquid streams, which, in common with system 180 discussed in conjunction with FIG. 4, shares carrier 103 including substrate 104 and sides 105 and 106, liquid desiccant 110, and liquid stream 181. Unlike system 180, air stream 101 in system 180 is replaced with a liquid stream 211, which can be a stream of aqueous material. Liquid stream 211 and liquid stream 181 flow countercurrently relative to one another, in which liquid stream 181 flows in the direction as indicated by arrowed line 181A and liquid stream 211 flows in the opposite direction as indicated the arrowed line denoted at 211A. Streams 211 and 181 can flow concurrently relative to one another, if desired. Also, one or each of streams 211 and 181 can be still, as in the form of a layer, if desired.

Like system 180, carrier 103 is wetted with liquid desiccant 110, which is hydrophilic. System 210 functions identically to system 180, and the discussion of system 180 applies to system 210, with the exception that the heat and mass transfer in system 210 occurs between liquid streams 211 and 181, rather than between air stream 101 and liquid stream 181. Also, although two liquid streams are interacting with carrier 103 in system 210, system 210 can be facilitated with more than two air and liquid streams, if desired.

Figure 8:
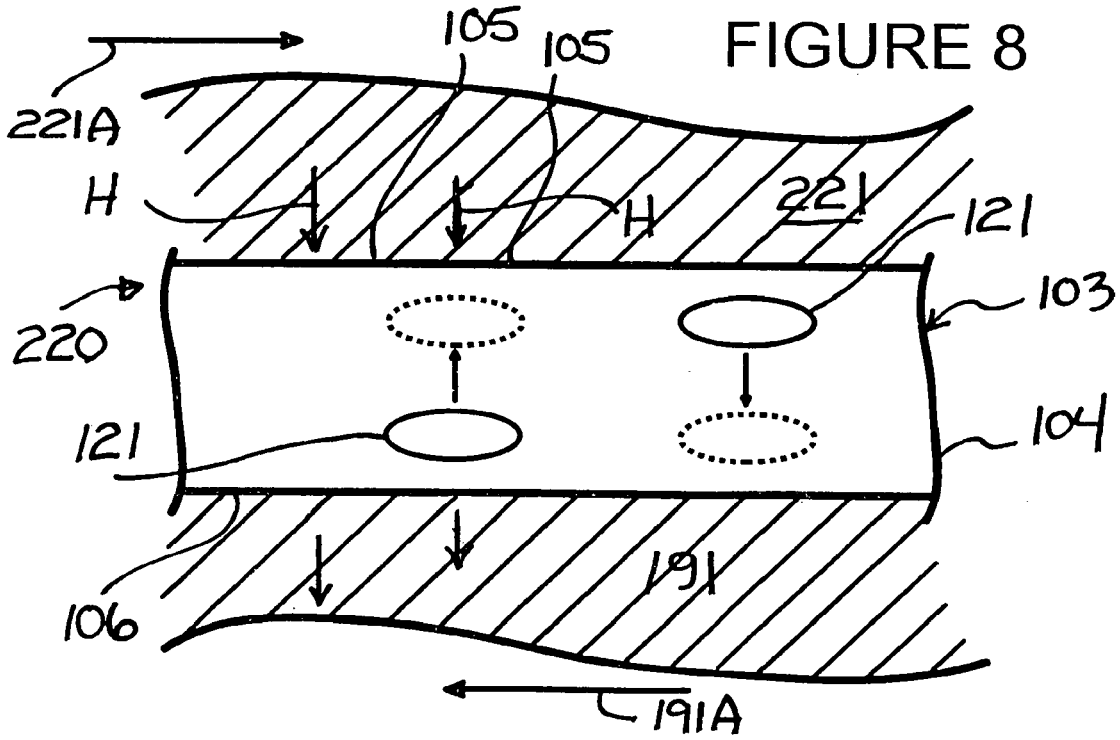
FIG. 8 is a schematic representation of a liquid-to-liquid heat transfer system constructed and arranged in accordance with the principle of the invention.

Referring now to FIG. 8, a system 220 for transferring heat between liquid streams is shown, which, in common with system 190, shares carrier 103 including substrate 104 and sides 105 and 106, hydrophobic liquid 121, and liquid stream 191. Unlike system 190 discussed in conjunction with FIG. 5, air stream 101 in system 190 is replaced with a liquid stream 221 in system 220, which can be a stream of aqueous material. Liquid stream 221 and liquid stream 191 flow countercurrently relative to one another, in which liquid stream 191 flows in the direction as indicated by arrowed line 191A and liquid stream 221 flows in the opposite direction as indicated the arrowed line denoted at 221A. Streams 221 and 191 can flow concurrently relative to one another, if desired. Also, one or each of streams 211 and 191 can be still, as in the form of a layer, if desired.

Substrate 104 is wetted with hydrophobic liquid 121. So wetted with hydrophobic liquid 121, substrate 104 acts as a carrier or support structure for hydrophobic liquid 121, in which the liquid permeable character of substrate 104 permits hydrophobic liquid 121 to move/circulate therethrough from side 105 to side 106. The infusion of hydrophobic liquid 121 in substrate 104 together create a dividing wall or partition which divides and isolates liquid stream 221 from liquid stream 191 and prevents them from mixing and interacting with one another, in accordance with the principle of the invention. System 220 functions identically to systems 190, and the discussion of system 190 applies to system 220, with the exception that the heat transfer in system 220 occurs between liquid streams 221 and 191, rather than between air stream 101 and liquid stream 191. Also, although two liquid streams are interacting with carrier 103 in system 220, system 220 can be facilitated with more than two air and liquid streams, if desired.

Figure 9:
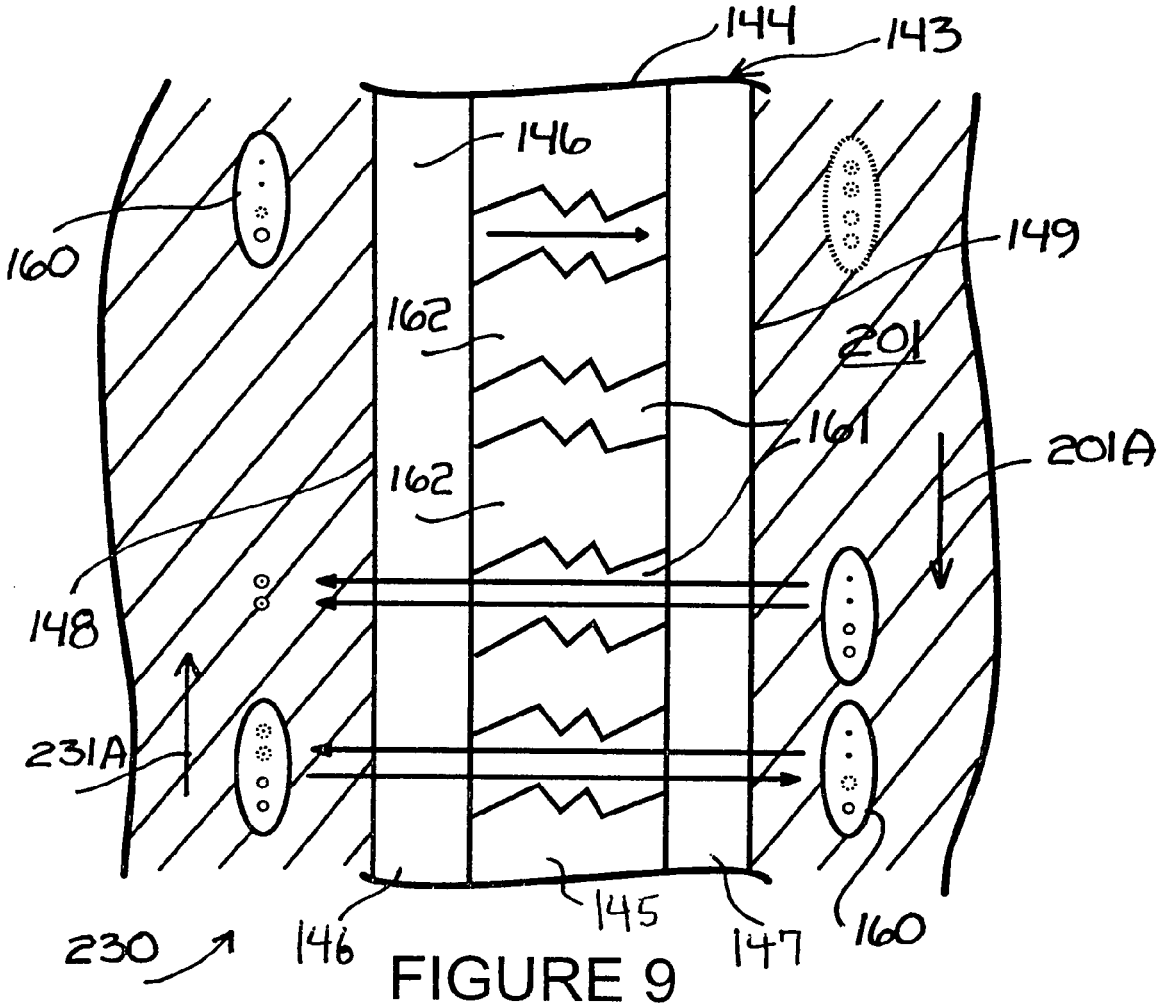
FIG. 9 is a schematic representation of a liquid-to-liquid mass transfer system constructed and arranged in accordance with the principle of the invention.

Referring now to FIG. 9, a system 230 for transferring mass between liquid streams is shown, which, in common with system 200, shares carrier 143 including substrate 144 with layers 145,146,147, sides 148 and 149, liquid desiccant 160, wick layers 161, insulator layers 162, and liquid stream 201. Unlike system 200 discussed in conjunction with FIG. 6, air stream 141 in system 200 is replaced with a liquid stream 231 in system 230, which can be a stream of aqueous material. Liquid stream 201 and liquid stream 231 flow countercurrently relative to one another, in which liquid stream 201 flows in the direction as indicated by arrowed line 201A and liquid stream 231 flows in the opposite direction as indicated the arrowed line denoted at 231A. Streams 231 and 201 can flow concurrently relative to one another, if desired. Also, one or each of streams 231 and 201 can be still, as in the form of a layer, if desired.

Substrate 144 is wetted with liquid desiccant 160. So wetted with liquid desiccant 160, substrate 144 acts as a carrier or support structure for liquid desiccant 160, and the infusion of liquid desiccant 160 in substrate 144 together create a dividing wall or partition which divides and isolates liquid stream 231 from liquid stream 201 and prevents them from mixing and interacting with one another, in accordance with the principle of the invention. System 230 functions identically to system 200, and the discussion of system 200 applies to system 230, with the exception that the heat transfer in system 230 occurs between liquid streams 231 and 201, rather than air stream 141 and liquid stream 201. Also, although two liquid streams are interacting with carrier 143 in system 230, system 230 can be facilitated with more than two air and liquid streams, if desired.

Respecting the embodiments set forth in FIGS. 1-9, it is to be understood that the carriers and the property-transferring materials govern the energy transfer between fluid streams, whether gas streams, gas and liquid streams, or liquid streams. Management of the carriers and the property-transferring materials also governs energy transfer, as does the flow rates of fluid streams. The flow characteristics of a liquid desiccant through a carrier are variable by varying the concentration of the liquid desiccant, and also varying the viscosity of the liquid desiccant. The flow characteristics of a hydrophobic liquid through a carrier are variable by varying the viscosity of the hydrophobic liquid, and also by varying the heat of the hydrophobic liquid. A carrier for use with the invention can also be made of varying liquid permeable materials for controlling the flow rate of a property-transferring material therethrough. According, energy transfer events carried out in the various embodiments of the invention set forth in FIGS. 1-9 can be controlled by controlling and/or varying the concentrations of liquid desiccants, the viscosity of liquid desiccants, the temperature of liquid desiccants, the temperature of hydrophobic liquids, the viscosity of hydrophobic liquids, the rate of flow of a property-transferring liquid through a carrier, introduction of heat or cold to carrier, heating or cooling a property-transferring material before it is applied to a carrier, and suitable combinations of the foregoing, and it is to be understood that this applies to all embodiments of the invention.

Again, fluids used in various embodiments set forth in FIGS. 1-9 need not be flowing or in the form of streams, but may be still, or circulating fluids, if desired. Also, the various embodiments of the invention set forth in FIGS. 1-9 may be used in conjunction with fluids and/or solids, if so desired, in which a solid can be a mass of solid particles, one or more blocks, bricks, slabs of rigid or semi-rigid materials, foam, wood, etc. Any combination of one or more fluids and/or one or more solids can be used in the various embodiments of the invention for providing property-transfer therebetween.

Figure 10A:
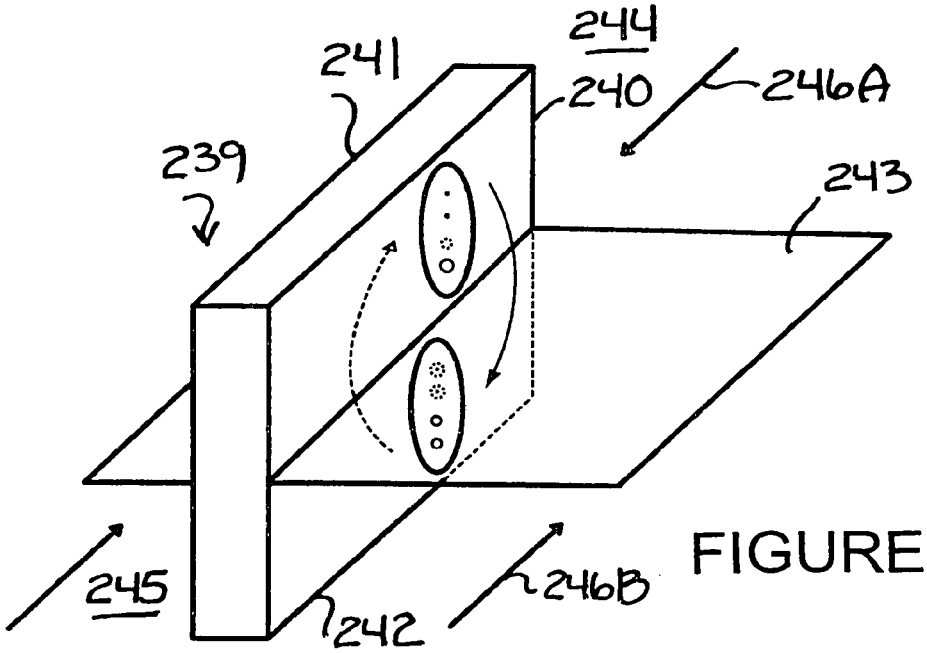
FIG. 10A is a schematic representation of an energy-transfer system constructed and arranged in accordance with the principle of the invention.

Further, in the embodiments set forth in FIGS. 1-9, property transfer occurs between opposing sides or surfaces of a carrier. As previously mentioned, property transfer can occur between other portions of a carrier, such as between opposing extremities of a carrier, and system 239 the embodiment in FIG. 10A is an example of this as it illustrates an upright carrier 240 having opposing extremities 241 and 242, and a transverse dividing wall 243 intersecting carrier 240 between extremities 241 and 242 defining opposing upper and lower regions 244 and 245 for accommodating substances, respectively, such fluids and/or solids, each of which can be present on one of the sides of carrier 240 or one both sides of carrier 240. In FIG. 10A, system 239 is employed with air streams, including air stream 246A at upper region 244 and air stream 246B at lower region 245. Air streams 246A and 246B interact with the same side of carrier 240, but can be located at opposing sides of carrier 240 or on both sides of carrier 240 if desired. Like the foregoing embodiments, carrier 240 is furnished with property-transferring material. Substances of unequal property-content at regions 244 and 245 interacting with the property-transferring material at extremities 241 and 242 produce in the property-transferring material micro-cyclic property transfer between extremities 241 and 242, in which the property-transfer material circulates between extremities 241 and 242 providing the disclosed micro-cyclic property transfer. Substances can be applied to opposing sides of carrier 240 at the opposing regions 244 and 245, in which micro-cyclic property transfer is made to occur not only between extremities 241 and 242, but also between opposing surfaces of extremities 241 and 242.

Figure 10B:
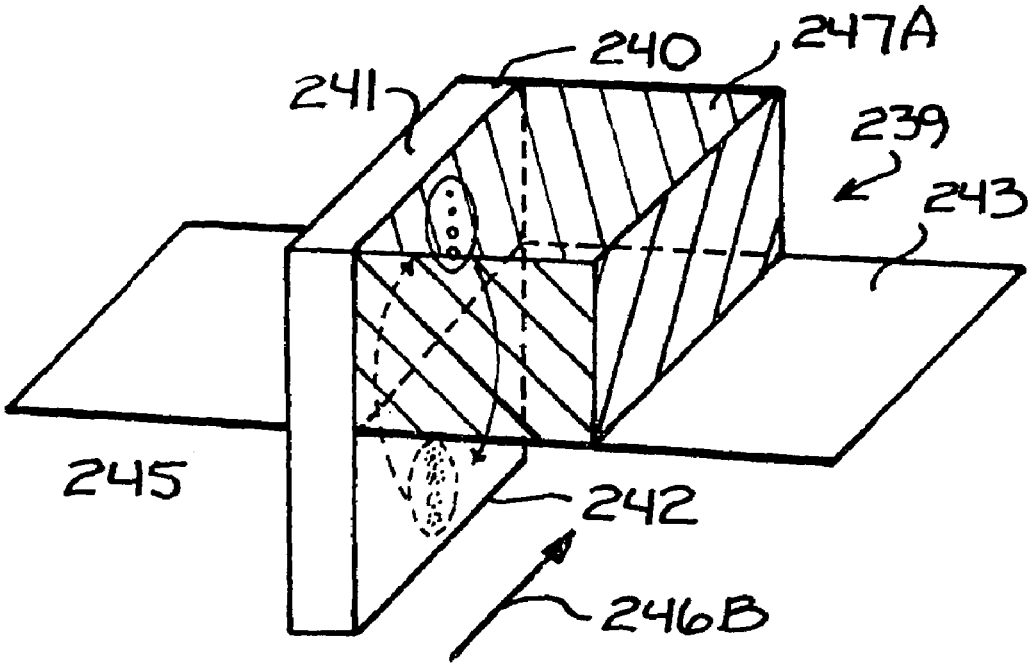
FIG. 10B is a schematic representation of the system of FIG. 10A showed as it would appear employed with a liquid and a gas.
Figure 10C:
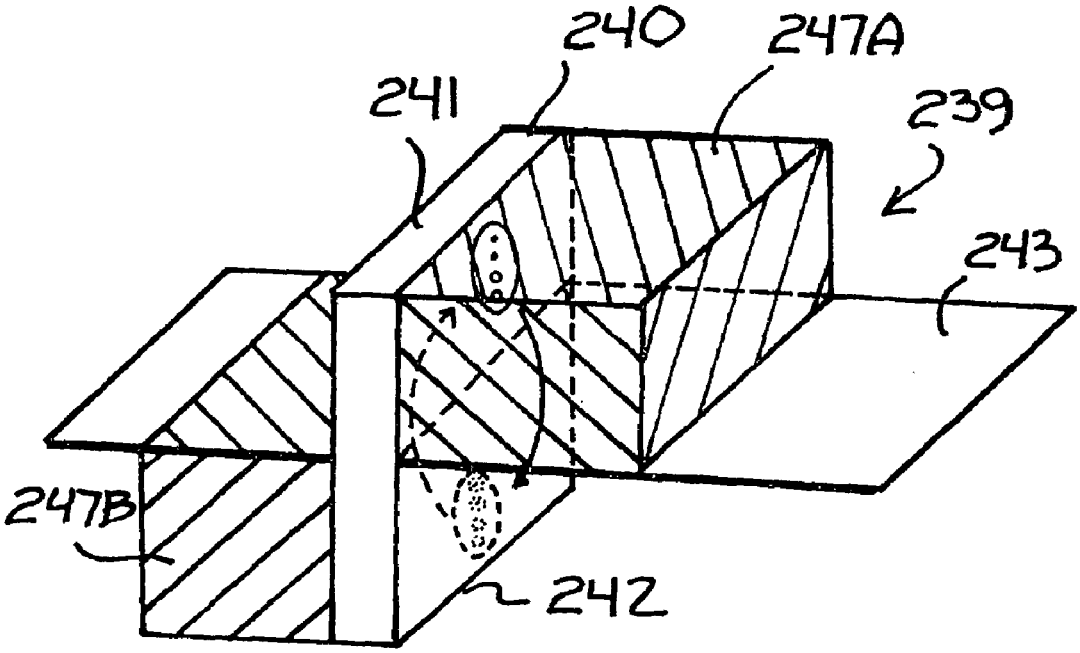
FIG. 10C is a schematic representation of the system of FIG. 10A showed as it would appear employed with liquids.

In FIG. 10B, system 239 is shown employed with an air stream and a liquid stream, including liquid stream 247A at upper region 244 and air stream 246B at lower region 245. Streams 247A and 246B interact with the same side of carrier 240, but can be located at opposing sides of carrier 240 or on both sides of carrier 240 if desired. In FIG. 10C, system 239 is shown employed with liquid streams, including liquid stream 247A at upper region 244 and liquid stream 247B at lower region 245. Streams 247A and 247B interact with opposing sides of carrier 240, but can be located on the same side of carrier 240 or on both sides of carrier 240 if desired. Although the embodiments set forth in FIGS. 10A-C are employed with streams of fluid, for each embodiment one or each of the streams can be still as in a layer, if desired. Solids can be employed as well.

From a structural standpoint, the foregoing embodiments of the invention can be implemented in various ways, and FIGS. 11-22 are set forth in an effort to show different implementations of foregoing described embodiments of the invention. The ensuing embodiments utilize the same carrier and property-transferring material properties as with the embodiments set forth in FIGS. 1-9.

Figure 11:
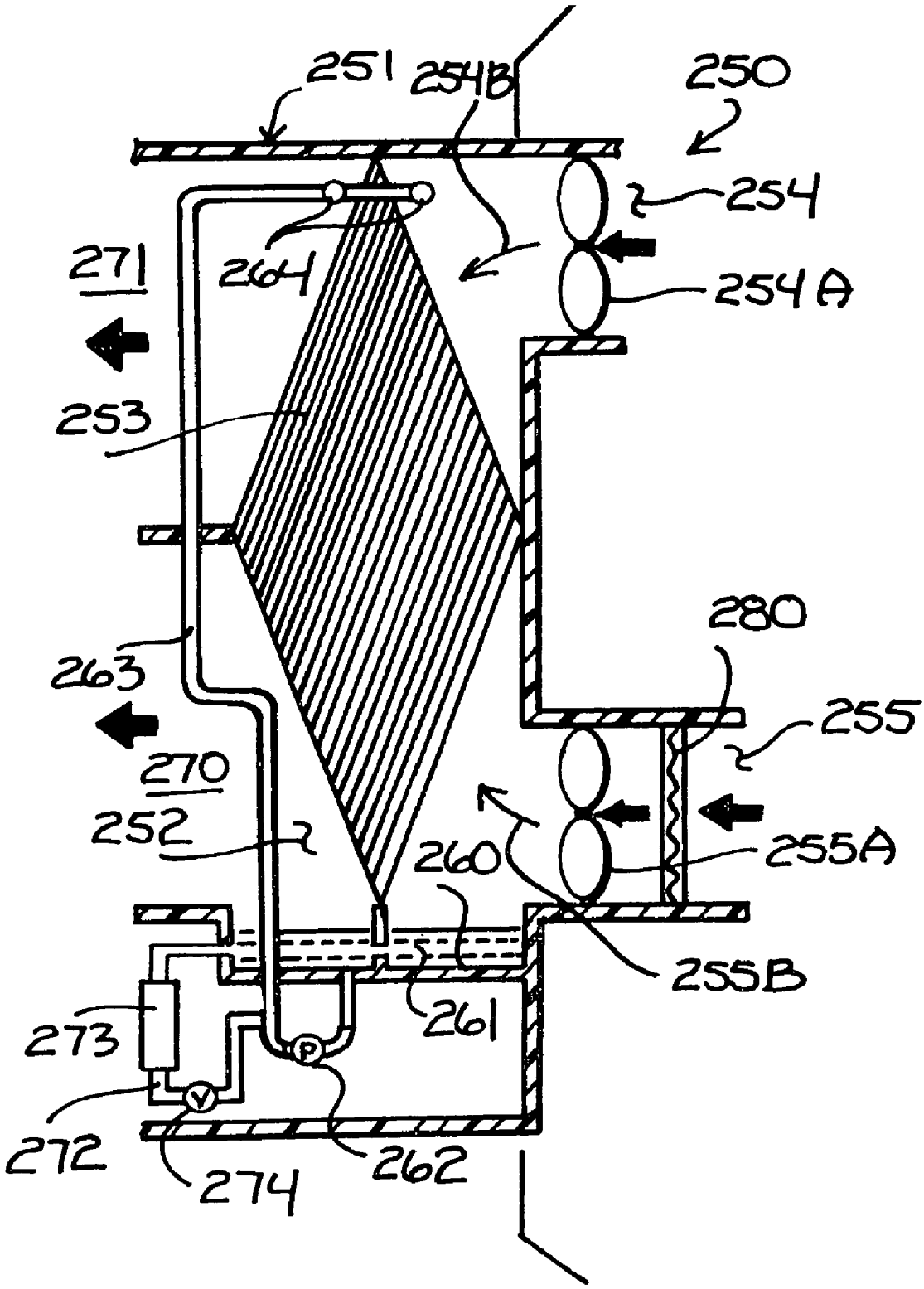
FIG. 11 is a schematic vertical sectional view of an energy transfer apparatus/system that is constructed and arranged in accordance with the principle of the invention.

Referring first to FIG. 11, an energy transfer system/apparatus 250 includes a housing 251 defining a chamber 252, a carrier 253 disposed in chamber 252, fluid inlets 254 and 255, and devices 254A and 255A, such as fans or blowers or the like, operative for developing fluid streams 254B and 255B into chamber 252 through inlets 254 and 255. Fluid streams 254B and 255B are streams of gas in the instant embodiment. Carrier 253 is in the form of a sheet or panel of liquid permeable substrate material like that of FIG. 1. A sump 260 supports property-transferring material 261, which is pumped by a pump 262 through a conduit 263 to nozzles 264, which discharge material 261 onto carrier 253. In system 250, it is to be understood that plumbing, namely, pump 262 and conduit 263, functions to deliver material 261 to carrier 253. Pump 262 can operate continually for continuing providing carrier 253 with material 261, intermittently for periodically providing carrier 153 with material 261, etc., and may be operated manually or automatically such as by way of a timer, etc. Carrier 253 is located above sump 260, which collects material 261 from carrier 253.

Fluid streams 254B and 255B pass into chamber 252 from inlets 254 and 255, interact with carrier 253 and material 261, and discharge outwardly through outlets 270 and 271, respectively, in which interaction of fluid streams 254B and 255A with material 261 supported by carrier 253 produces micro-cyclic energy transfer between fluid streams 254B and 255B. Depending on the type of material used for material 261, and also the nature of carrier 253, as in the embodiments set forth in FIGS. 1-9, the micro-cyclic energy transfer between fluid steams 254B and 255B can be heat and mass, heat, or mass. A conduit 272 couples a conventional filter unit 273 to conduit 263 between pump 262 and nozzles 264 for diverting property-transferring material 261 from conduit 263 to remove particulate matter therefrom before it is returned to sump 260. A valve 274 in conduit 272 is provided for regulating the flow of material 261 to filter 273. A heat transfer device 280, such as heat transfer coils or the like, is positioned at inlet 255, which can be used to heat or cool fluid stream 255B before it interacts with the property-transferring material carried by carrier 253. A heat transfer device can also be used in conjunction with inlet 254, if desired. Ensuing embodiments of the invention can also incorporate such heat transfer devices at inlets for heating or cooling the fluid streams before interaction with property-transferring material support by one or more carriers, in accordance with the principle of the invention.

Figure 13:
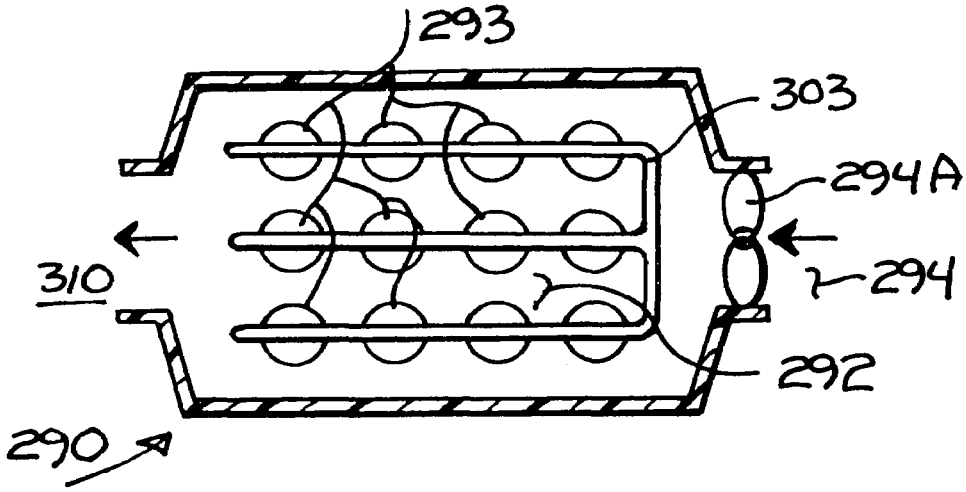
FIG. 13 is a schematic top plan view of the apparatus/system of FIG. 12.
Figure 12:
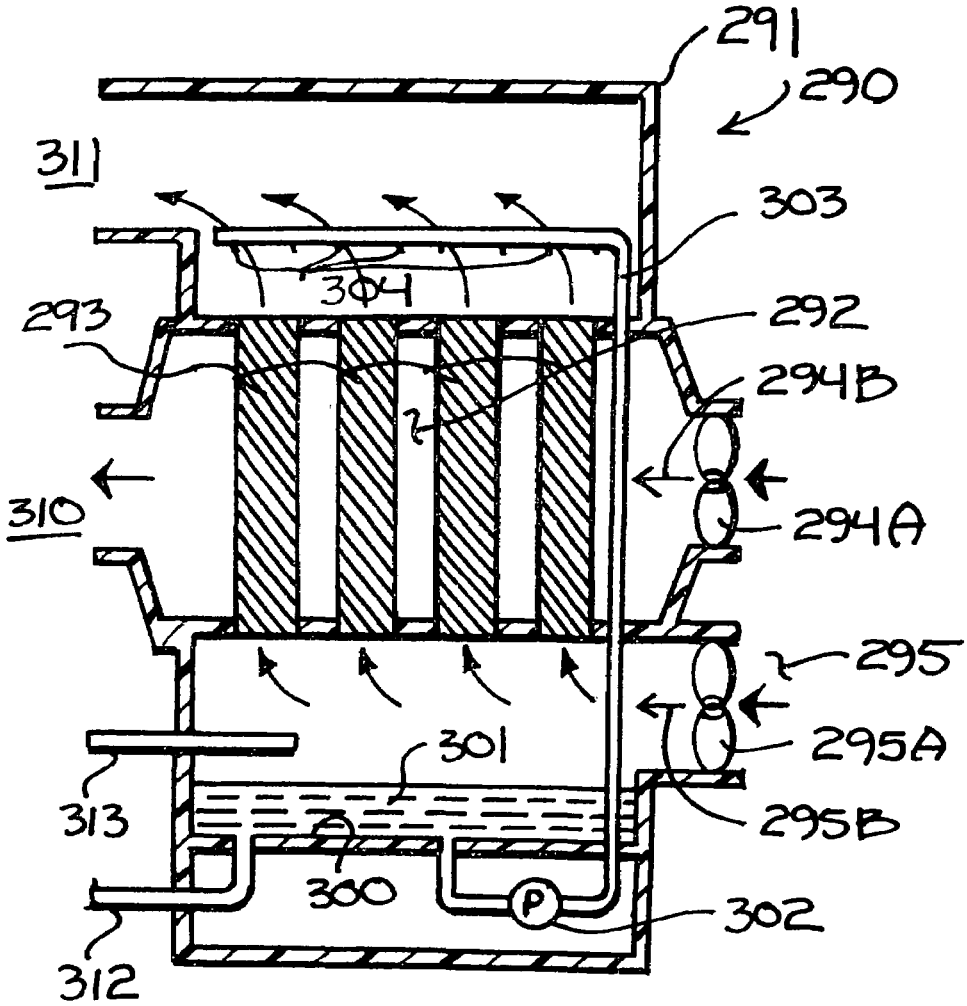
FIG. 12 is a schematic vertical sectional view of another embodiment of an energy transfer apparatus/system that is constructed and arranged in accordance with the principle of the invention.

Looking now to FIG. 12, an energy transfer system/apparatus 290 includes a housing 291 defining a chamber 292, upright carriers 293 disposed in chamber 292, fluid inlets 294 and 295, and devices 294A and 295A, such as fans or blowers or the like, or such as propeller pumps or other kinds of liquid moving devices operative for developing fluid streams 294B and 295B into chamber 292 through inlets 294 and 295. Carriers 293 are columns of liquid permeable substrate material in the embodiment set forth in FIG. 11. FIG. 13 is a schematic top plan view of system 290 illustrating carriers 293, and although twelve carriers 293 are employed, less or more can be used as desired. A sump 300 supports property-transferring material 301, which is pumped by a pump 302 through a conduit 303 to nozzles 304, which discharge material 301 onto carriers 293. In system 290, it is to be understood that plumbing, namely, pump 302 and conduit 303, functions to deliver material 301 to carriers 293. Pump 302 can operate continually for continuing providing carriers 293 with material 301, intermittently for periodically providing carriers 293 with material 301, etc., and may be operated manually or automatically such as by way of a timer, etc. Carriers 293 are located above sump 300, which collects material 301 from carriers 293.

Fluid streams 294B and 295B pass into chamber 292 from inlets 294 and 295, interact with carrier 293 and material 301, and discharge outwardly through outlets 310 and 311, respectively, in which interaction of fluid streams 294B and 295A with material 301 supported by carrier 293 produces micro-cyclic energy transfer between fluid streams 294B and 295B. Depending on the type of material used for material 301, and also the nature of carrier 293, as in the embodiments set forth in FIGS. 1-9, the micro-cyclic energy transfer between fluid steams 294B and 295B can be heat and mass, heat, or mass. A conduit 312 coupled to sump 300 can be provided, if desired, and used to direct material 301 to a heat exchange/altering device (not shown) than can be configured to change or maintain the temperature of material 301 before it is returned to sump 300 by way of conduit 313. In this way, the temperature of material 301 in sump 300 can be controlled, and also maintained at relatively constant suitable temperatures.

Figure 14:
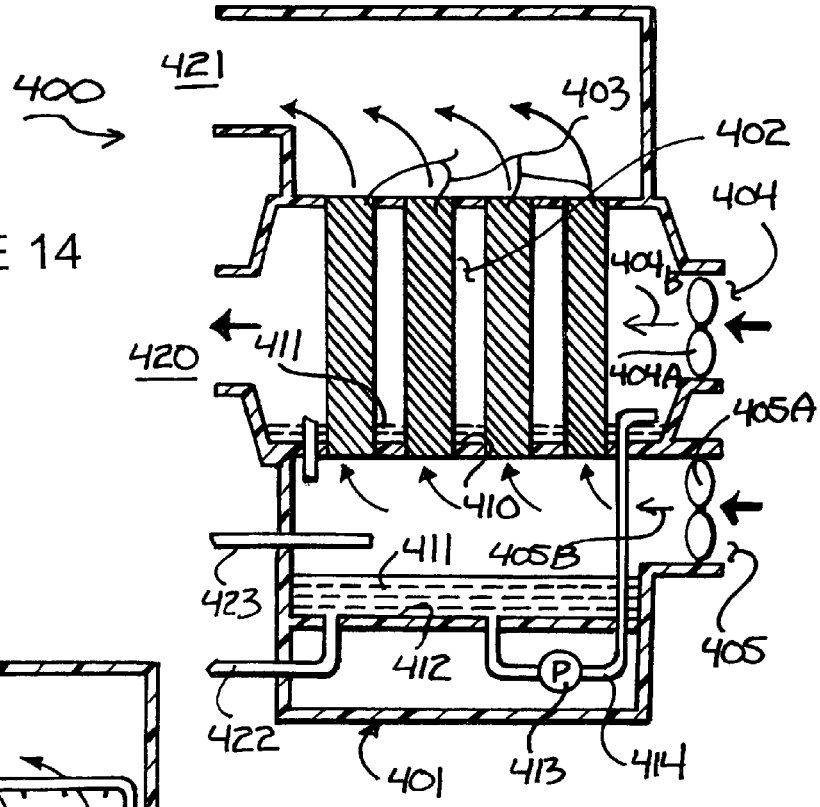
FIG. 14 is a schematic vertical sectional view of yet another embodiment of an energy transfer apparatus/system that is constructed and arranged in accordance with the principle of the invention.

Looking now to FIG. 14, an energy transfer system/apparatus 400 includes a housing 401 defining a chamber 402, upright carriers 403 disposed in chamber 402, fluid inlets 404 and 405, and devices 404A and 405A, such as fans or blowers or the like, or such as propeller pumps or other kinds of liquid moving devices operative for developing fluid streams 404B and 405B into chamber 402 through inlets 404 and 405. Fluid streams 404B and 405B are streams of gas in the instant embodiment. Carriers 403 are columns of liquid permeable substrate material in the embodiment set forth in FIG. 14. Although four carriers 403 are employed, less or more can be used as desired. A sump 410 supports property-transferring material 411, and lower ends of carriers 403 are positioned in material 411, in which material 411 is drawn upwardly into carriers 403 by way of wicking. A supply sump 412 also supports material 411, which is pumped by a pump 413 through a conduit 414 sump 410 to replenish it with material 411 as the need arises. In system 400, it is to be understood that wicking functions deliver material 401 to carriers 403.

Fluid streams 404B and 405B pass into chamber 402 from inlets 404 and 405, interact with carrier 403 and material 411, and discharge outwardly through outlets 420 and 421, respectively, in which interaction of fluid streams 404B and 405A with material 411 supported by carrier 403 produces micro-cyclic energy transfer between fluid streams 404B and 405B. Depending on the type of material used for material 411, and also the nature of carrier 403, as in the embodiments set forth in FIGS. 1-9, the micro-cyclic energy transfer between fluid steams 404B and 405B can be heat and mass, heat, or mass. A conduit 422 coupled to supply sump 412 can be provided, if desired, and used to direct material 411 to a heat exchange/altering device (not shown) than can be configured to change or maintain the temperature of material 411 before it is returned to sump 412 by way of conduit 423. In this way, the temperature of material 411 in sump 412 can be controlled, and also maintained at relatively constant suitable temperatures.

Figure 15:
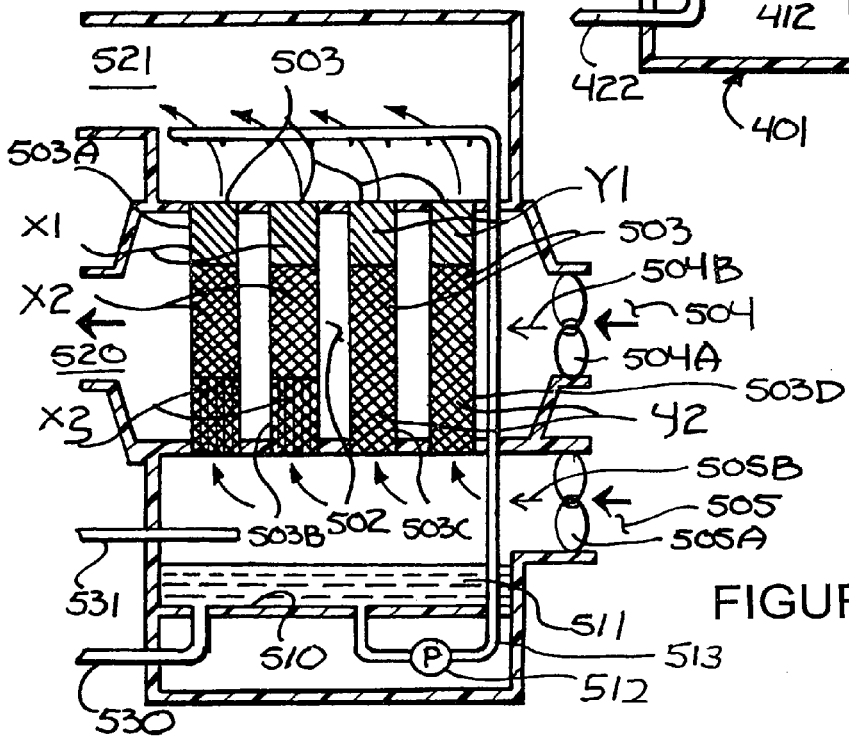
FIG. 15 is a schematic vertical sectional view of yet still another embodiment of an energy transfer apparatus/system that is constructed and arranged in accordance with the principle of the invention.

Referring now to FIG. 15, an energy transfer system/apparatus 500 includes a housing 501 defining a chamber 502, upright carriers 503 disposed in chamber 502, fluid inlets 504 and 505, and devices 504A and 505A, such as fans or blowers or the like, or such as propeller pumps or other kinds of liquid moving devices operative for developing fluid streams 504B and 505B into chamber 502 through inlets 504 and 505. Fluid streams 504B and 505B are streams of gas in the instant embodiment. Carriers 503 are columns of liquid permeable substrate material in the embodiment set forth in FIG. 15. Although four carriers 503 are employed, namely, carriers 503A-503D, less or more can be used as desired. Carrier 503A and 503B have three discrete sections x1,x2,x3, respectively, corresponding to three different substrate materials having different liquid permeability characteristics, and carriers 503C and 503D have two discrete sections y1,y2 corresponding to two different substrate materials having different liquid permeability characteristics. A sump 510 supports property-transferring material 511, which is pumped by a pump 512 through a conduit 513 to nozzles 514, which discharge material 511 onto carriers 505. In system 500, it is to be understood that plumbing, namely, pump 512 and conduit 513, functions to deliver material 511 to carriers 503. Pump 512 can operate continually for continuing providing carriers 503 with material 511, intermittently for periodically providing carriers 503 with material 511, etc., and may be operated manually or automatically such as by way of a timer, etc. Carriers 503 are located above sump 510, which collects material 511 from carriers 503.

Fluid streams 504B and 504B pass into chamber 502 from inlets 504 and 505, interact with carriers 503 and material 511, and discharge outwardly through outlets 520 and 521, respectively, in which interaction of fluid streams 504B and 505A with material 511 supported by carriers 503 produces micro-cyclic energy transfer between fluid streams 504B and 505B. The liquid permeable characteristics of carriers 503A and 503B are different from the liquid permeable characteristics of carriers 503C and 503D, in which material 511 flows through carriers 503C and 503D faster than carriers 503A and 503B. This difference in flow rates of material 511 causes energy transfer events between fluid streams at carriers 503C and 503D to be different from the energy transfer events between fluid streams at carriers 503A and 503B. Depending on the type of material used for material 511, and also the nature of carrier 503, as in the embodiments set forth in FIGS. 1-9, the micro-cyclic energy transfer between fluid steams 504B and 505B can be heat and mass, heat, or mass. A conduit 522 coupled to sump 510 replenishes sump 510 with material 511 as the need arises. Consistent with the discussion of system 500, it is to be understood that carriers 503 may each be constructed having any selected material 511 flow characteristics, according to the principle of the invention. A conduit 530 coupled to sump 510 can be provided, if desired, and used to direct material 511 to a heat exchange/altering device (not shown) than can be configured to change or maintain the temperature of material 511 before it is returned to sump 510 by way of conduit 531. In this way, the temperature of material 511 in sump 510 can be controlled, and also maintained at relatively constant suitable temperatures.

Figure 17:
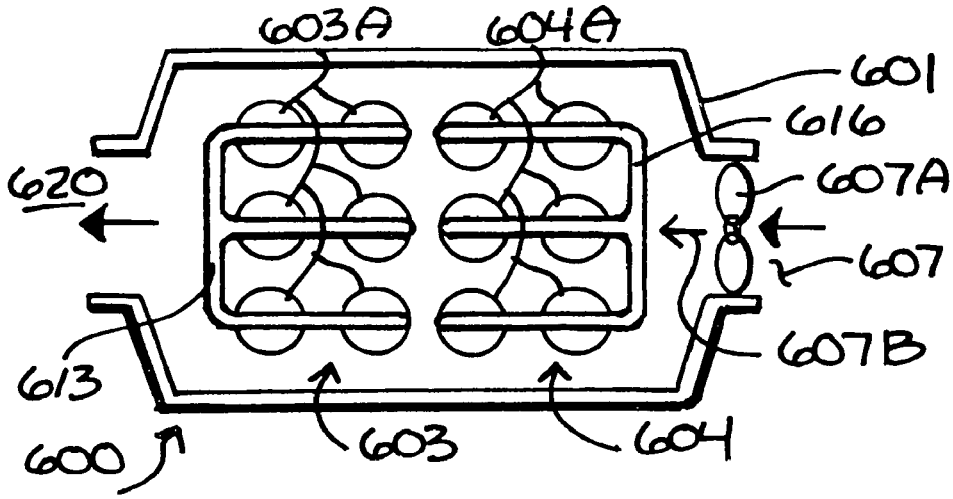
FIG. 17 is a schematic top plan view of the apparatus/system of FIG. 16.
Figure 16:
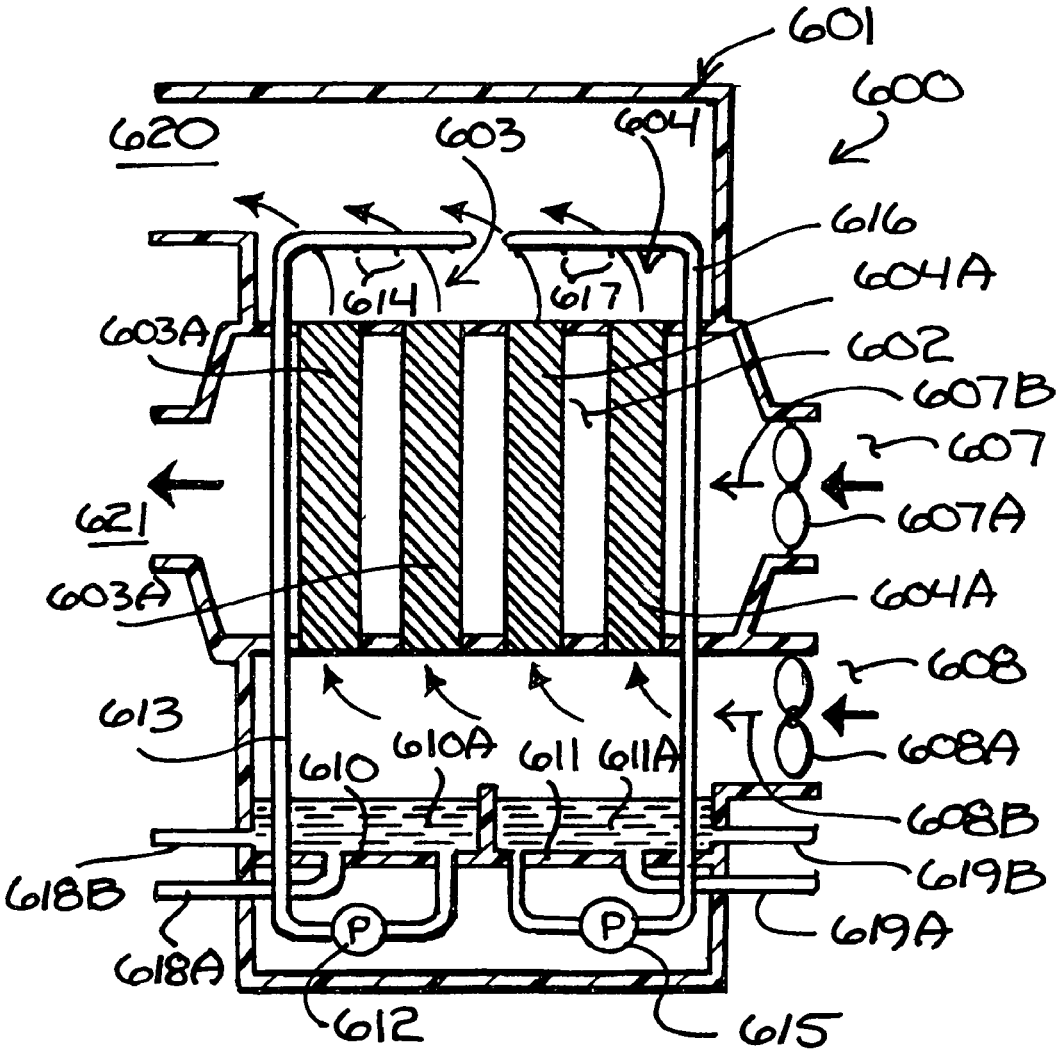
FIG. 16 is a schematic vertical sectional view of a further embodiment of an energy transfer apparatus/system that is constructed and arranged in accordance with the principle of the invention.

Reference is now made to FIG. 16, in which there is seen an energy transfer system/apparatus 600 including a housing 601 defining a chamber 602, a set 603 upright carriers 603A and a set 604 of upright carriers 604A disposed in chamber 602, fluid inlets 606 and 607, and devices 6046 and 607A, such as fans or blowers or the like, or such as propeller pumps or other kinds of liquid moving devices operative for developing fluid streams 607B and 608B into chamber 602 through inlets 607 and 608. Fluid streams 607B and 608B are streams of gas in the instant embodiment. Carriers 603A and 604A are columns of liquid permeable substrate material in the embodiment set forth in FIG. 16. FIG. 17 is a schematic top plan view of system 600 illustrating carriers set 603 of carriers 603A and set 604 of carriers 604A. Although six carriers 603A are employed with set 603, less or more can be used. Although six carriers 604A are employed with set 604, less or more can be used.

Sumps 610 and 611 support property-transferring materials 610A and 611A, in which property-transferring material 610A is different from property-transferring material 611A. Material 610A is pumped by a pump 612 through a conduit 613 to nozzles 614, which discharge material 610A onto carriers 603A. Material 611A is pumped by a pump 615 through a conduit 616 to nozzles 617, which discharge material 611A onto carriers 604A.

In system 600, it is to be understood that plumbing, namely, pump 612 and conduit 613, functions to deliver material 610A to carriers 603A, and that plumbing, namely, pump 615 and conduit 616, functions to deliver material 611A to carriers 604A. Pumps 612 and 615 can operate continually for continuing providing carriers 603A and 604A with materials 610A and 611A, respectively, intermittently for periodically providing carriers 603A and 604A with materials 610A and 611A, respectively, etc., and may be operated manually or automatically such as by way of a timer, etc. Carriers 603A and 604A are located above sumps 610 and 611, respectively, which collect materials 610A and 611A from carriers 603A and 604A, respectively.

Fluid streams 607B and 608B pass into chamber 602 from inlets 607 and 608, interact with carriers 603A and 604A and materials 610A and 611A, and discharge outwardly through outlets 620 and 621, respectively, in which interaction of fluid streams 607B and 608B with materials 610A and 611A supported by carriers 603A and 604A produces micro-cyclic energy transfer between fluid streams 607B and 608B.

Because materials 610A and 611A are different, they provide different energy transfer characteristics, such as different types of energy transfer (such as heat for one of sets 603,604 and mass for the other of sets 603, 604), different levels of the same or different types of energy transfer, and/or different rates of the same or different energy transfer, which will depend on the type of material used for each of materials 610A and 611A, and also on the nature of carriers 603A and 604A as in the embodiments set forth in FIGS. 1-9. Materials 610A and 611A can be different in many ways, including being different types of materials, different types of materials in which one is of a different temperature than the other, or the same material in which one is of a different temperature than the other.

A conduit 618A coupled to sump 610 can be provided, if desired, and used to direct material 610A to a heat exchange/altering device (not shown) than can be configured to change or maintain the temperature of material 610A before it is returned to sump 610 by way of conduit 618B. In this way, the temperature of material 610A in sump 610 can be controlled, and also maintained at relatively constant suitable temperatures. Also, a conduit 619A coupled to sump 611 can be provided, if desired, and used to direct material 611A to a heat exchange/altering device (not shown) than can be configured to change or maintain the temperature of material 611A before it is returned to sump 611 by way of conduit 619B. In this way, the temperature of material 611A in sump 611 can be controlled, and also maintained at relatively constant suitable temperatures.

Figure 19:
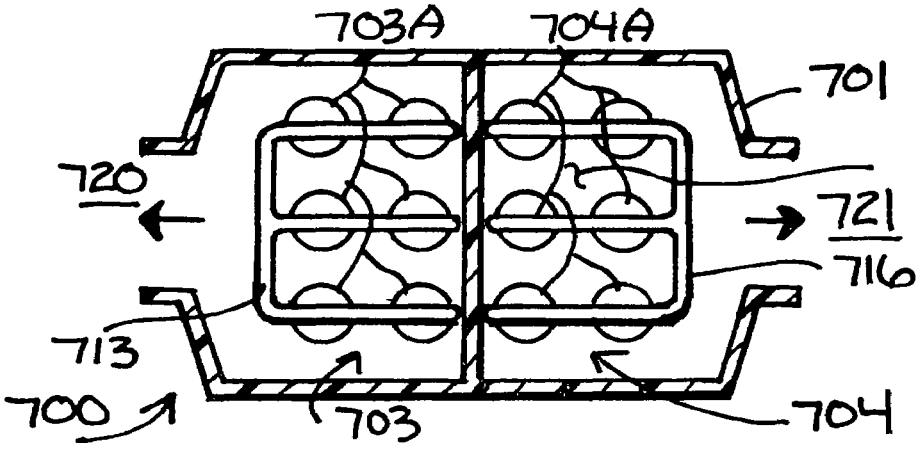
FIG. 19 is a schematic top plan view of the apparatus/system of FIG. 18.
Figure 18:
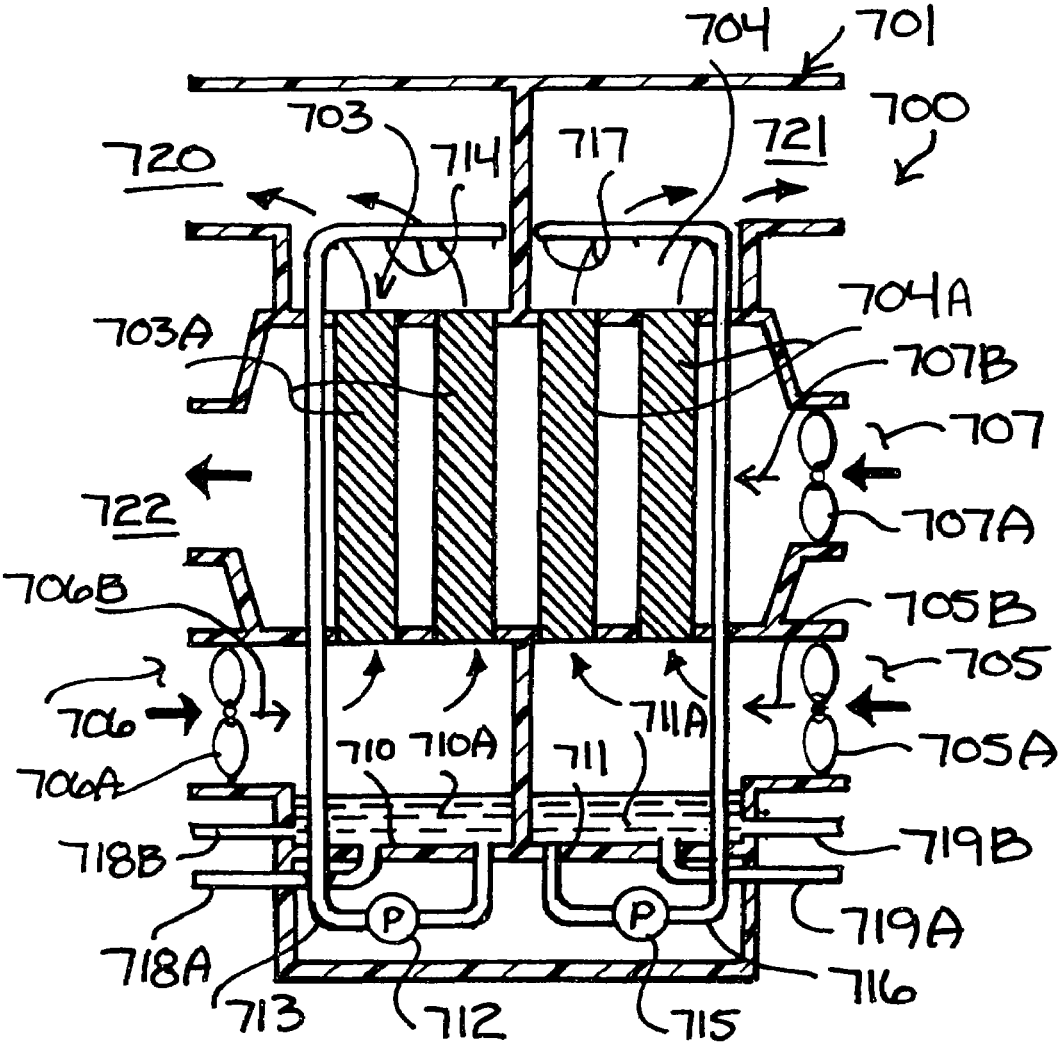
FIG. 18 is a schematic vertical sectional view of yet a further embodiment of an energy transfer apparatus/system that is constructed and arranged in accordance with the principle of the invention.

Referring to FIG. 18, an energy transfer system/apparatus 700 is shown, which includes a housing 701 defining a chamber 702, set 703 upright carriers 703A and set 704 of upright carriers 704A disposed in chamber 702, fluid inlets 705, 706, and 707, devices 705A, 706A, and 707A, such as fans or blowers or the like, or such as propeller pumps or other kinds of liquid moving devices operative for developing fluid streams 705B, 706B, and 707B into chamber 702 through inlets 705, 706, and 707, respectively. Fluid streams 705B, 706B, and 707B are streams of gas in the instant embodiment. Carriers 703A and 704A are columns of liquid permeable substrate. FIG. 19 is a schematic top plan view of system 700 illustrating carriers set 703 of carriers 703A and set 704 of carriers 704A. Although six carriers 703A are employed with set 703, less or more can be used. Although six carriers 704A are employed with set 704, less or more can be used.

Sumps 710 and 711 support property-transferring materials 710A and 711A, in which property-transferring material 710A is different from property-transferring material 711A. Material 710A is pumped by a pump 712 through a conduit 713 to nozzles 714, which discharge material 710A onto carriers 703A. Material 711A is pumped by a pump 715 through a conduit 716 to nozzles 717, which discharge material 711A onto carriers 704A.

In system 700, it is to be understood that plumbing, namely, pump 712 and conduit 713, functions to deliver material 710A to carriers 703A, and that plumbing, namely, pump 715 and conduit 716, functions to deliver material 711A to carriers 704A. Pumps 712 and 715 can operate continually for continuing providing carriers 703A and 704A with materials 710A and 711A, respectively, intermittently for periodically providing carriers 703A and 704A with materials 710A and 711A, respectively, etc., and may be operated manually or automatically such as by way of a timer, etc. Carriers 703A and 704A are located above sumps 710 and 711, respectively, which collect materials 710A and 711A from carriers 703A and 704A, respectively.

Fluid streams 705B, 706B, and 707B pass into chamber 702 from inlets 705, 706, and 707, interact with carriers 703A and 704A and materials 710A and 711A, and discharge outwardly through outlets 720, 721, and 722, respectively, in which interaction of fluid streams 705B, 706B, and 707B with materials 710A and 711A supported by carriers 703A and 704A produces micro-cyclic energy transfer between fluid streams 705B, 706B, and 707B.

Because materials 710A and 711A are different, they provide different energy transfer characteristics, such as different types of energy transfer (such as heat for one of sets 703,704 and mass for the other of sets 703,704), different levels of the same or different types of energy transfer, and/or different rates of the same or different energy transfer, which will depend on the type of material used for each of materials 710A and 711A, and also on the nature of carriers 703A and 704A as in the embodiments set forth in FIGS. 1-9. Materials 710A and 711A can be different in many ways, including being different types of materials, different types of materials in which one is of a different temperature than the other, or the same material in which one is of a different temperature than the other.

A conduit 718A coupled to sump 710 can be provided, if desired, and used to direct material 710A to a heat exchange/altering device (not shown) than can be configured to change or maintain the temperature of material 710A before it is returned to sump 710 by way of conduit 718B. In this way, the temperature of material 710A in sump 710 can be controlled, and also maintained at relatively constant suitable temperatures. Also, a conduit 719A coupled to sump 711 can be provided, if desired, and used to direct material 711A to a heat exchange/altering device (not shown) than can be configured to change or maintain the temperature of material 711A before it is returned to sump 711 by way of conduit 719B. In this way, the temperature of material 711A in sump 711 can be controlled, and also maintained at relatively constant suitable temperatures.

Figure 20:
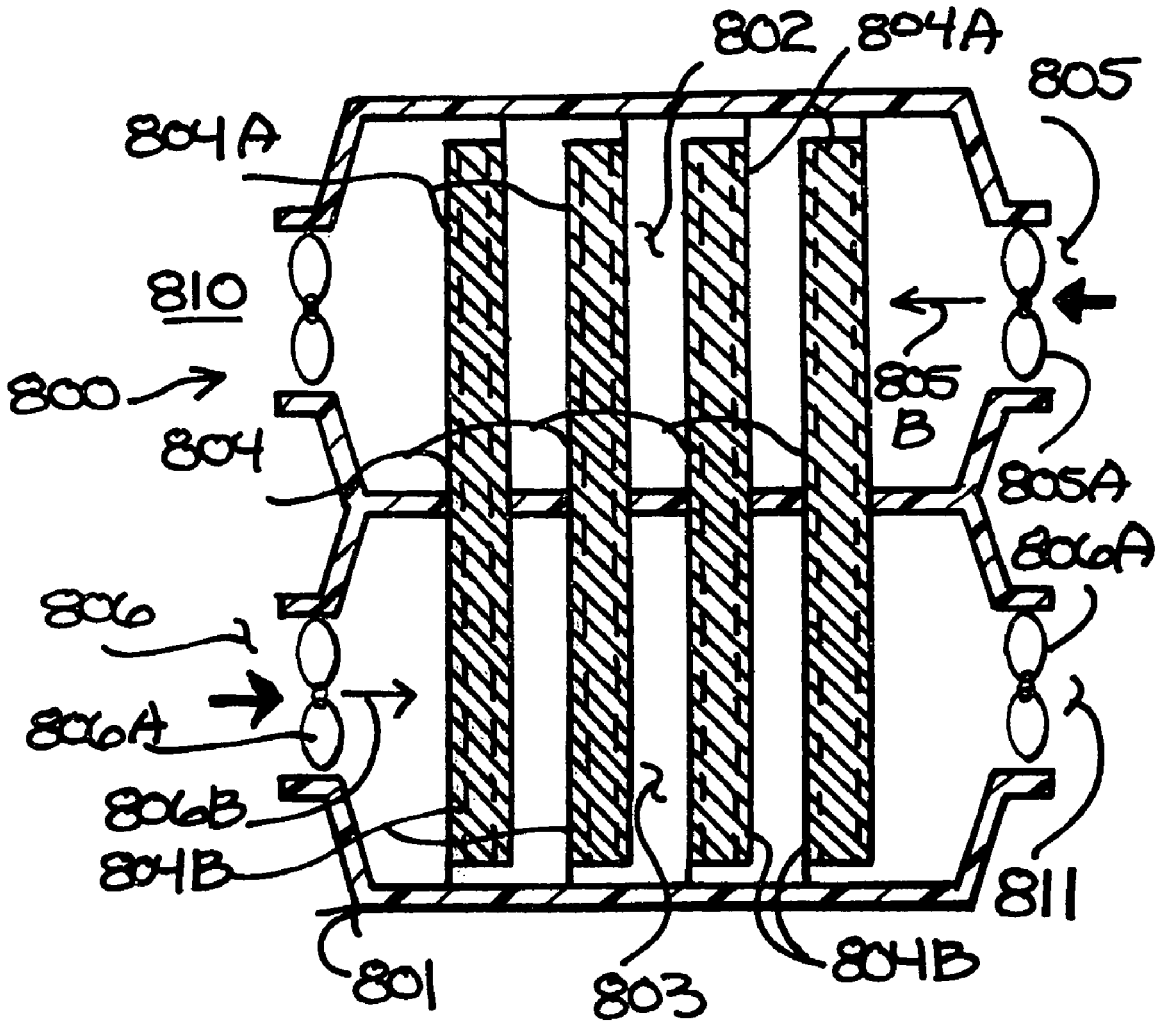
FIG. 20 is a schematic vertical sectional view of yet still a further embodiment of an energy transfer apparatus/system that is constructed and arranged in accordance with the principle of the invention.

Reference is now made to FIG. 20, in which there is seen an energy transfer system/apparatus 800 including a housing 801 defining opposing chambers 802 and 803, upright carriers 804, fluid inlets 805 and 806, and devices 805A and 806A, such as fans or blowers or the like, or such as propeller pumps or other kinds of liquid moving devices operative for developing fluid streams 805B and 806B into chambers 802 and 803, respectively, through inlets 805 and 806, respectively. Fluid streams 805B and 806B can be steams of gas, steams of liquid, or a stream of gas and a stream of liquid. Carriers 804 are shown as columns, which have extremities/sides 804A disposed in chamber 802 and opposing extremities/sides 804B disposed in chamber 803. Although four carriers 804 are employed in system 800, less or more can be used. Depending on the types of materials used and also the nature of carriers 804, as in the embodiments set forth in FIGS. 10A, 10B and 10C, the micro-cycle energy transfer between fluid streams can be heat and mass, heat or mass.

Carriers 804 are wetted with a property-transferring material, and fluid streams 805B and 806B pass into chambers 802 and 803, respectively, from inlets 805 and 806, respectively. Fluids streams 805B and 806B interact with sides 804A and 804B, respectively, of carriers 804 and the property-transferring material carried thereby, and discharge outwardly through outlets 810 and 811, respectively, in which interaction of fluid streams 805B and 806B with the property-transferring material at sides 804A and 804B, respectively, of carriers 804 produces micro-cyclic energy transfer between fluid streams 805B and 806B.

The fluids used in various embodiments set forth in FIGS. 11-20 need not be flowing or in the form of streams, but may be still, such as in the form of layers, or circulating fluids, if desired. Also, the various embodiments of the invention set forth in FIGS. 11-20 may be used in conjunction with fluids and/or solids, when appropriate, in which a solid can be a mass of solid particles, one or more blocks, bricks, slabs of rigid or semi-rigid materials, foam, wood, etc. Any combination of one or more fluids and/or one or more solids, when appropriate, can be used in the various embodiments of the invention for providing property-transfer therebetween. In the case of streams of liquids, fans or blowers for producing air streams can be replaced with suitable fluid pumps. In some instances, gravity can be used as the mechanism for producing a liquid stream.

The invention has been described above with reference to preferred embodiments, and the various embodiments set forth in FIGS. 11-20 are illustrative of various applications of the invention, in which aspects of each may be mixed and matched according to the teachings set forth throughout this specification, and also multiplied as needed for providing the desired results. Those skilled in the art will readily appreciate that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. Apparatus comprising:

a liquid permeable substrate having a first surface and an opposed second surface, the liquid permeable substrate permeable to heat and mass transfer therethrough between the first and second surfaces;

a liquid desiccant carried by and permeating the liquid permeable substrate, the liquid desiccant capable of circulating in the substrate between the first surface of the substrate and the second surface of the substrate;

a first air stream having a first heat and moisture content flowing parallel to the second surface of the substrate in heat and mass transfer proximity with the second air stream flowing directionally different than the first air stream;

a second air stream having a second heat and moisture content flowing parallel to the second surface of the substrate in heat and mass transfer proximity with the second air stream flowing directionally different than the first air stream;

the first heat and moisture content of the first air stream greater than the second heat and moisture content of the second air stream;

the first air stream interacting with the first surface of the substrate exposing the liquid desiccant at the first surface of the substrate to the first heat and moisture content of the first air stream;

the second air stream interacting with the second surface of the substrate exposing the liquid desiccant at the second surface of the substrate to the second heat and moisture content of the second air stream;

a temperature and concentration differential imparted to the liquid desiccant from the first surface of the substrate to the second surface of the substrate in response to exposure of the liquid desiccant at the first surface of the substrate to the first heat and moisture content of the first air stream and exposure of the liquid desiccant at the second surface of the substrate to the second heat and moisture content of the second air stream causing the liquid desiccant to develop micro-cyclic energy transfer in the liquid desiccant between the first surface of the substrate and the second surface of the substrate transferring heat and moisture from the first heat and moisture content of the first air stream to the second heat and moisture content of the second air stream thereby reducing the heat and moisture content of the first air stream and increasing the heat and moisture content of the second air stream.

2. Apparatus according to claim 1, further comprising a heat exchange device associated with the liquid desiccant.

3. Apparatus according to claim 1, further comprising a heat exchange device associated with the first air stream.

4. Apparatus according to claim 1, further comprising a heat exchange device associated with the second air stream.

5. Apparatus according to claim 1, further comprising the substrate coupled to receive replenishing liquid desiccant from a replenishing source of liquid desiccant.

6. Apparatus comprising:

a liquid permeable substrate having a first surface and an opposed second surface, the liquid permeable substrate permeable to heat and mass transfer therethrough between the first and second surfaces;

a liquid desiccant held by and permeating the liquid permeable substrate, the liquid desiccant capable of circulating in the substrate between the first surface of the substrate and the second surface of the substrate;

a first air stream having a first moisture content flowing parallel to the first surface of the substrate in mass transfer proximity;

a second air stream having a second moisture content flowing parallel to the second surface of the substrate in mass transfer proximity with the second air stream flowing directionally different than the first air stream;

the first moisture content of the first air stream greater than the second moisture content of the second air stream;

the first air stream interacting with the first surface of the substrate exposing the liquid desiccant at the first surface of the substrate to the first moisture content of the first air stream;

the second air stream interacting with the second surface of the substrate exposing the liquid desiccant at the second surface of the substrate to the second moisture content of the second air stream;

a concentration differential imparted to the liquid desiccant from the first surface of the substrate to the second surface of the substrate in response to exposure of the liquid desiccant at the first surface of the substrate to the first moisture content of the first air stream and exposure of the liquid desiccant at the second surface of the substrate to the second moisture content of the second air stream causing the liquid desiccant to develop micro-cyclic energy transfer in the liquid desiccant between the first surface of the substrate and the second surface of the substrate transferring moisture from the first moisture content of the first air stream to the second moisture content of the second air stream thereby reducing the moisture content of the first air stream and increasing the moisture content of the second air stream.

7. Apparatus according to claim 6, further comprising a heat exchange device associated with the liquid desiccant.

8. Apparatus according to claim 6, further comprising a heat exchange device associated with the first air stream.

9. Apparatus according to claim 6, further comprising a heat exchange device associated with the second air stream.

10. Apparatus according to claim 6, further comprising the substrate coupled to receive replenishing liquid desiccant from a replenishing source of liquid desiccant.

* * * * *